US005338649A

United States Patent [19]

Inaba et al.

[11] Patent Number: 5,338,649

[45] Date of Patent: Aug. 16, 1994

[54] PHOTOGRAPHIC PROCESSING COMPOSITION AND BLEACHING OR BLEACH-FIXING METHOD

[75] Inventors: Tadashi Inaba; Hisashi Okada; Ryo Suzuki; Yasuhiro Katsuoka; Hiroyuki Seki, all of Kanagawa, Japan

[73] Assignee: Fuji Photo Film Co., Ltd., Kawagawa, Japan

[21] Appl. No.: 120,461

[22] Filed: Sep. 14, 1993

[30] Foreign Application Priority Data

Sep. 17, 1992 [JP] Japan ..... 4-247814

[51] Int. Cl.[5] ..... G03C 7/00; G03C 5/44; G03C 5/38; G03C 5/42

[52] U.S. Cl. ..... 430/430; 430/393; 430/418; 430/460; 430/461; 430/963

[58] Field of Search ..... 430/393, 418, 430, 460, 430/461, 963

[56] References Cited

U.S. PATENT DOCUMENTS

| | | | |
|---|---|---|---|
| 4,563,405 | 1/1986 | Ishikawa et al. | 430/460 |
| 5,009,985 | 4/1991 | Kunitz et al. | 430/461 |
| 5,070,004 | 12/1991 | Fujita et al. | 430/393 |
| 5,149,618 | 9/1992 | Tappe et al. | 430/393 |
| 5,238,791 | 8/1993 | Tappe et al. | 430/393 |

FOREIGN PATENT DOCUMENTS

| | | | |
|---|---|---|---|
| 0199604 | 10/1986 | European Pat. Off. | 430/460 |
| 0430000 | 6/1991 | European Pat. Off. . | |
| 3912551 | 10/1990 | Fed. Rep. of Germany . | |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A process for bleaching or bleach-fixing an imagewise exposed silver halide photographic material is provided, comprising developing in a color developing solution and bleaching or bleach-fixing in a processing composition having a bleaching capacity containing as a bleaching agent a metal chelate compound of a chelate-forming compound or salt thereof and a metal ion selected from the group consisting of Fe(III), Mn(III), Co(III), Rh(II), Rh(III), Au(II), Au(III) and Ce(IV), the chelate-forming compound or salt thereof is represented by formula (I):

(I)

wherein $G_1$ and $G_2$ each represents a carboxyl group, a phosphono group, a sulfo group, a hydroxyl group, a mercapto group, an aryl group, a heterocyclic group, an alkylthio group, an amidino group, a guanidino group or a carbamoyl group; $L_1$, $L_2$ and $L_3$ each represents a divalent aliphatic group, a divalent aromatic group or a divalent connecting group formed by a combination of a divalent aliphatic group and a divalent aromatic group; m and n each represents an integer 0 or 1; R represents a hydrogen atom, an aliphatic group or an aromatic group; and M represents a hydrogen atom or a cation.

20 Claims, No Drawings

PHOTOGRAPHIC PROCESSING COMPOSITION AND BLEACHING OR BLEACH-FIXING METHOD

FIELD OF THE INVENTION

The present invention relates to a processing composition for processing a silver halide photographic material not harmful to the environment, and a processing method using the processing composition. More particularly, the present invention relates to a processing composition for processing a silver halide color photographic material having a bleaching capacity containing a bleaching agent which exhibits excellent biodegradability and excellent bleaching capacity even at a low concentration, and a processing method using this processing composition.

BACKGROUND OF THE INVENTION

In general, a silver halide black-and-white photographic material which has been exposed to light is then subjected to processing procedures, including black-and-white development, fixing, rinsing, etc. A silver halide color photographic material (hereinafter referred to as "color photographic light-sensitive material") which has been exposed to light is then subjected to processing procedures, including color development, desilvering, rinsing, stabilization, etc. A silver halide color reversal photographic material which has been exposed to light is then subjected to processing procedures, including black-and-white development and reversal, followed by color development, desilvering, rinsing, stabilization, etc.

In the color development procedure, silver halide grains which have been exposed to light are reduced with a color developing agent to silver, while the resulting oxidation product of the color developing agent undergoes reaction with a color coupler to form a dye image.

In the subsequent desilvering procedure, developed silver which has been produced in the development procedure is oxidized (bleached) with a bleaching agent (oxidizer) having an oxidative effect to form a silver salt. The photographic material is then processed with a fixing agent to form a soluble silver which is eventually removed from the light-sensitive layer together with unused silver halide (fixing). Bleaching and fixing may be effected separately as a bleaching step and a fixing step, or may be effected simultaneously as a blixing step. For details of these processing procedures and compositions, reference can be made to James, "The Theory of Photographic Process", 4th edition, 1977, and *Research Disclosure* Nos. 17643 (pp. 28–29), 18716 (left column - right column, p. 651), and 307105 (pp. 880–881).

In addition to the foregoing basic processing procedures, various auxiliary procedures may be conducted for maintaining the photographic and physical quality of dye image or processing stability or like purposes. Examples of these auxiliary procedures include a rinsing procedure, a stabilizing procedure, a hardening procedure, and a stop procedure.

In order to adjust the gradation or like properties of a silver halide black-and-white photographic material which has been developed, a reducer containing an oxidizer is used.

The oxidizer incorporated into the processing solution for use in the foregoing bleaching or reducing procedure is typically ferric ethylenediaminetetraacetate complex salt or ferric 1,3-diaminopropanetetraacetate complex salt, which compounds are not biodegradable. In recent years, from the standpoint of environmental protection, it has been desired to render the waste liquid from these photographic processing procedures harmless to human beings. In particular, easily biodegradable processing compositions have been desired. Substitutes for the foregoing unbiodegradable bleaching agents have been studied.

Biodegradable bleaching agents that have been proposed include ferric complex salt of N-(2-carboxymethoxyphenyl) iminodiacetic acid as disclosed in West German Patent Application (OLS) 3,912,551 and ferric complex salt of $\beta$-alaninediacetic acid or glycinedipropionic acid as disclosed in European Patent Application 430000A. However, processing solutions having a bleaching capacity containing these bleaching agents leave much to be desired in desilvering properties. These processing solutions have been found to be disadvantageous in that when used in continuous processing, their desilvering properties are gradually lowered as the processing proceeds and bleaching fog is increased, or the processed photographic materials tend to become stained with time.

In these color processing systems, small-sized automatic developing machines called miniature laboratories have recently become wide spread to provide rapid processing service to customers. Accordingly, the stability of photographic properties in continuous processing is indispensable, notwithstanding the need for rapid bleaching.

Furthermore, again from the standpoint of environmental protection, it has been desired to lower the concentration of metal chelate compounds used as bleaching agents. However, the foregoing bleaching agents cannot provide sufficient desilvering properties at low concentrations.

SUMMARY OF THE INVENTION

It is therefore an object of the present invention to provide an easily handleable processing composition, the waste liquid of which does not harm the environment, and a processing method using this composition.

It is another object of the present invention to provide a processing composition having a bleaching capacity which exhibits excellent desilvering properties even at low concentrations, and a processing method using this composition.

It is yet another object of the present invention to provide a processing composition having a bleaching capacity which causes little bleach fog, and a processing method using this composition.

It is yet another object of the present invention to provide a processing composition having a bleaching capacity which causes little staining of a processed photographic material with time, and a processing method using this composition.

It is yet another object of the present invention to provide a processing composition which can invariably exhibits small variation in the foregoing photographic properties even during continuous processing, and a processing method using this composition.

It is yet another object of the present invention to provide a processing composition which is readily biodegradable or environmentally safe, and a processing method using this composition.

These and other objects of the present invention will become more apparent from the following detailed description and Examples.

The foregoing objects of the present invention are accomplished by providing a processing composition for processing a silver halide photographic material, comprising at least one Fe(III), Mn(III), Co(III), Rh(II), Rh(III), Au(II), Au(III) and Ce(IV), said chelate-forming compound being represented by formula (I):

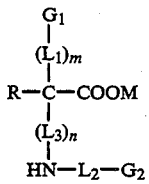

(I)

wherein $G_1$ and $G_2$ each independently represents a carboxyl group, a phosphono group, a sulfo group, a hydroxyl group, a mercapto group, an aryl group, a heterocyclic group, an alkylthio group, an amidino group, a guanidino group or a carbamoyl group; $L_1$, $L_2$ and $L_3$ each independently represents a divalent aliphatic group, a divalent aromatic group or a divalent connecting group formed by a combination of a divalent aliphatic group and a divalent aromatic group; m and n each independently represents an integer 0 or 1; R represents a hydrogen atom, an aliphatic group or an aromatic group; and M represents a hydrogen atom or a cation. The foregoing objects of the present invention are also accomplished by a processing method using the above described composition.

DETAILED DESCRIPTION OF THE INVENTION

The compound represented by formula (I) and salts thereof are described in detail below.

$G_1$ and $G_2$ each represents a carboxyl group, a phosphono group, a sulfo group, a hydroxyl group, a mercapto group, an aryl group, a heterocyclic group, an alkylthio group, an amidino group, a guanidino group or a carbamoyl group.

The aryl group (aromatic hydrocarbon group) represented by $G_1$ or $G_2$ may be a monocyclic or bicyclic preferably $C_{6-20}$, aryl group such as a phenyl group and a naphthyl group. This aryl group may be substituted. Examples of such substituents include an alkyl group (e.g., methyl, ethyl), an aralkyl gnoup (e.g., phenylmethyl), an alkenyl group (e.g., allyl), an alkinyl group, an alkoxy group (e.g., methoxy, ethoxy), an aryl group (e.g., phenyl, p-methylphenyl), an acylamino group (e.g., acetylamino), a sulfonylamino group (e.g., methanesulfonylamino), an ureide group, an alkoxycarbonylamino group (e.g., methoxycarbonylamino), an aryloxycarbonylamino group (e.g., phenoxycarbonylamino), an aryloxy group (e.g., phenyloxy), a sulfamoyl group (e.g., methylsulfamoyl), a carbamoyl group (e.g., carbamoyl, methylcarbamoyl), an alkylthio group (e.g., methylthio, carboxylmethylthio), an arylthio group (e.g., phenylthio), a sulfonyl group (e.g., methanesulfonyl), a sulfinyl group (e.g., methanesulfinyl), a hydroxyl group, a halogen atom (e.g., chlorine, bromine, fluorine), a cyano group, a sulfo group, a carboxyl group, a phosphono group, an aryloxycarbonyl group (e.g., phenyloxycarbonyl), an acyl group (e.g., acetyl, benzoyl), an alkoxycarbonyl group (e.g., methoxycarbonyl), an acyloxy group (e.g., acetoxy), a nitro group, and a hydroxamic group.

The heterocyclic group represented by $G_1$ or $G_2$ is a 3- to 10-membered heterocyclic group containing at least one of nitrogen, oxygen and sulfur atoms. The heterocyclic group may be saturated or unsaturated or may be monocyclic, or may form a condensed ring with other aromatic rings or heterocycles. The heterocyclic group is preferably a 5- or 6-membered unsaturated heterocyclic group. Examples of the heterocyclic group include pyridine, pyrazine, pyrimidine, pyridazine, triazine, tetrazine, thiophene, furan, pyrrole, imidazole, pyrazole, thiazole, isothiazole, oxazole, isoxazole, oxadiazole, thiadiazole, thianthrene, isobenzofuran, chromene, xanthene, phenoxathiin, indolizine, isoindole, indole, triazole, triazolium, tetrazole, quinolizine, isoquinoline, quinoline, phthalazine, naphthyridine, quinoxaline, quinazoline, cinnoline, pterindine, carbazole, carboline, phenanthridine, acridine, pteridine, phenanthroline, phenazine, phenothiazine, phenoxazine, chroman, pyrroline, pyrazoline, indoline, and isoindoline. Preferred among these heterocyclic groups are pyridine, pyrazine, pyrimidine, pyridazine, thiophene, furan, pyrrole, imidazole, pyrazole, thiazole, isothiazole, oxazole, isoxazole and indole. Further preferred among these heterocyclic groups are imidazole and indole.

The alkylthio group represented by $G_1$ or $G_2$ may be represented by $-SR_1$ (in which $R_1$ represents an alkyl group). The alkyl group represented by $R_1$ is a straight-chain, branched or cyclic alkyl group, preferably having 1 to 10 carbon atoms. A $C_{1-4}$ straight-chain alkyl group is particularly preferred. The alkyl group represented by $R_1$ may be substituted. Examples of useful substituents include those described with reference to $G_1$ and $G_2$. Specific examples of the alkylthio group represented by $G_1$ or $G_2$ include a methylthio group, an ethylthio group, a hydroxyethylthio group, and a carboxylmethylthio group. Preferred among these alkylthio groups are methylthio group and ethylthio group.

The carbamoyl group represented by $G_1$ or $G_2$ may be substituted and thus may be represented by $-CONR_1'R_2$ in which $R_1'$ and $R_2$ each represents a hydrogen atom or an alkyl or aryl group which may be substituted.

The alkyl group represented by $R_1'$ or $R_2$ may be straight-chain, branched or cyclic. The alkyl group preferably has 1 to 10 carbon atoms. The aryl group represented by $R_1$ or $R_2$ is preferably a $C_{6-10}$ aryl group, more each other to form a ring. Examples of the ring formed by the connection of $R_1'$ to $R_2$ include a morpholine ring, a piperidine ring, a pyrrolidine ring and a piperazine ring. Particularly preferred examples of the group represented by $R_1'$ or $R_2$ include a hydrogen atom, a $C_{1-4}$ alkyl group which may be substituted, and a phenyl group which may be substituted.

Examples of substituents for the alkyl or aryl group represented by $R_1'$ or $R_2$ include those described with reference to the aryl group represented by $G_1$ or $G_2$.

Specific examples of the carbamoyl group represented by $G_1$ or $G_2$ include a carbamoyl group, a N-methylcarbamoyl group, a N-phenylcarbamoyl group and a morpholinocarbonyl group.

$G_1$ is preferably a carboxyl group, a hydroxyl group, an aryl group or a heterocyclic group and more preferably a carboxyl group. $G_2$ is preferably a carboxyl group, a hydroxyl group, a sulfo group, a phosphono group, an aryl group or a heterocyclic group, more preferably a carboxyl group, an aryl group or heterocyclic group and further more preferably a carboxyl group.

Examples of the divalent aliphatic group represented by $L_1$, $L_2$ or $L_3$ include a straight-chain, branched or cyclic alkylene group (preferably having 1 to 6 carbon atoms), alkenylene group (preferably having 2 to 6 carbon atoms), and alkinylene group (preferably having 2 to 6 carbon atoms). The divalent aliphatic group represented by $L_1$, $L_2$ or $L_3$ may be substituted. Examples of such substituents include those described with reference to the aryl group represented by $G_1$ or $G_2$. Preferred among these substituents are carboxyl group and hydroxyl group. Further preferred among these substituents is carboxyl group.

Specific examples of the divalent aliphatic group represented by $L_1$, $L_2$ or $L_3$ include methylene group, ethylene group, 1-carboxy-methylene group, 1-carboxy-ethylene group, 2-hydroxy-ethylene group, 2-hydroxy-propylene group, 1-phosphono-methylene group, 1-phenyl-methylene group, and 1-carboxy-butylene group.

Examples of the divalent aromatic group represented by $L_1$, $L_2$ or $L_3$ include a divalent aromatic hydrocarbon group (arylene group) and a divalent aromatic heterocyclic group.

The divalent aromatic hydrocarbon group (arylene group) may be monocyclic or bicyclic. The divalent aromatic hydrocarbon group preferably has 6 to 20 carbon atoms. Examples of such a divalent aromatic hydrocarbon group include phenylene group and naphthylene group.

The divalent aromatic heterocyclic group is a 3- to 10-membered aromatic heterocyclic group containing at least one of nitrogen, oxygen and sulfur atoms which may be monocyclic ring or may form a condensed ring with other aromatic rings or heterocyclic rings. The divalent aromatic heterocyclic group is preferably a 5- or 6-membered aromatic heterocyclic group containing a nitrogen atom as a hetero atom.

Examples of the divalent aromatic heterocyclic group include the following groups:

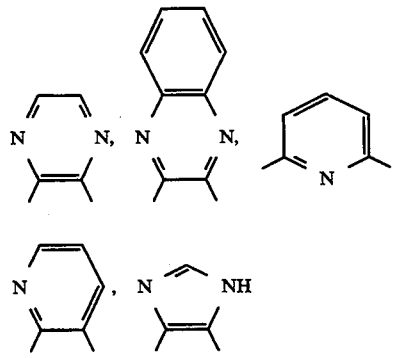

The divalent aromatic group is preferably an arylene group (preferably having 6 to 20 carbon atoms), more preferably phenylene group or naphthylene group, particularly phenylene group.

The divalent aromatic group represented by $L_1$, $L_2$ or $L_3$ may be substituted. Examples of such substituents include those described with reference to the aryl group represented by $G_1$ or $G_2$. Preferred among these substituents are carboxyl group, hydroxyl group, and aryl group. Further preferred among these substituents is carboxyl group.

$L_1$, $L_2$ and $L_3$ each may represent a combination of a divalent aliphatic group and a divalent aromatic group (as defined above). Examples of such a combination include the following groups:

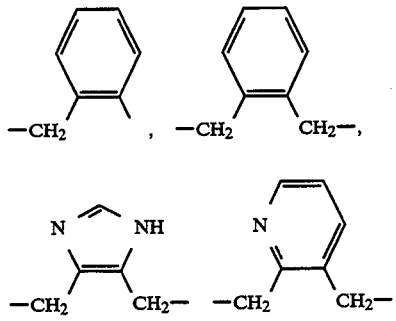

$L_1$, $L_2$ and $L_3$ each is preferably a $C_{1-3}$ alkylene or phenylene group which may be substituted, particularly methylene or ethylene group which may be substituted.

The suffixes m and n each represents an integer 0 or 1. The suffix m is preferably 1. The suffix n is preferably The aliphatic group represented by R is a straight-chain, branched or cyclic alkyl group (preferably having 1 to 6 carbon atoms), alkenyl group (preferably having 2 to 6 carbon atoms) or alkinyl group (preferably having 2 to 6 carbon atoms), preferably alkyl group or alkenyl group. Examples of such an aliphatic group include methyl group, ethyl group, cyclohexyl group, benzyl group, and allyl group.

The aromatic group represented by R may be an aromatic hydrocarbon group (aryl group) or aromatic heterocyclic group (preferably having 6 to 20 carbon atoms). The aromatic heterocyclic group is a 3- to 10-membered ring containing at least one of nitrogen atom, oxygen atom and sulfur atom and may be a monocyclic ring or may form a condenced ring with other aromatic rings or heterocyclic rings. The aromatic heterocyclic group is preferably a 5- or 6-membered ring containing at least one nitrogen atom. Examples of such an aromatic hyrocarbon or heterocyclic group include phenyl group, naphthyl group, 2-pyridyl group, and 2-pyrrole group. Preferred among these groups is aryl group. Further preferred among these aryl groups is phenyl group.

R is preferably a hydrogen atom or $C_{1-3}$ alkyl group, more preferably a hydrogen atom.

The cation represented by M includes ammonium (e.g., ammonium, tetraethylammonium), alkali metal (e.g., lithium, potassium, sodium), and pyridinium, preferably alkali metal, and more preferably potassium and sodium.

The compound represented by formula (I) may be in the form of ammonium salt (e.g., ammonium salt, tetraethylammonium salt), alkali metal salt (e.g., lithium salt, sodium salt, potassium salt) or acidic salt (e.g., hydrochloride, sulfate, oxatate), preferably alkali metal salt or ammonium salt, and more preferably ammonium salt.

After isolatation, the compound of formula (I) of the present invention preferably contains 0 to 6 ammonium, alkali metal atoms or acid groups (e.g., monosodium salt, disodium salt, trisodium salt).

Preferred among compounds represented by formula (I) are those represented by the following formula (II):

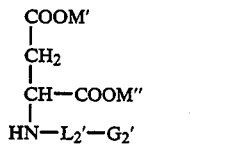
(II)
wherein $L_2'$ has the same meaning as $L_2$ in formula (I); $G_2'$ has the same meaning as $G_2$ in formula (I); and M' and M'' each has the same meaning as M in formula (I).
Specific examples of the compound represented by formula (I) are given below, but the present invention should not be construed as being limited thereto.
1.
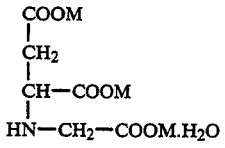
M: 2H, Na
2.
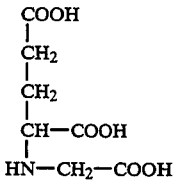
3.
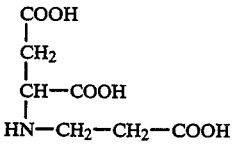
4.
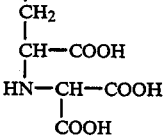
5.
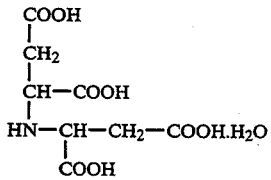
6.
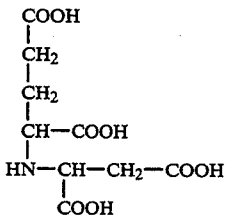
7.
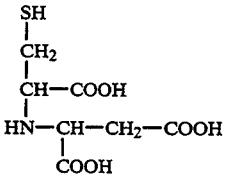
-continued
8.
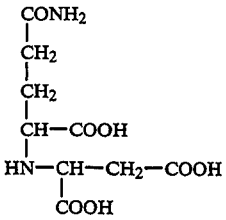
9.
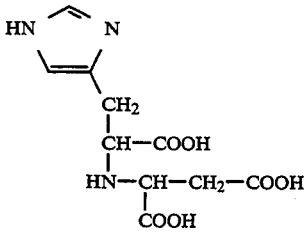
10.
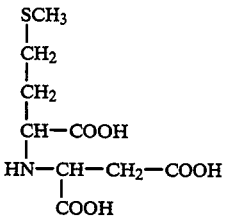
11.
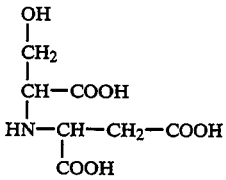
12.
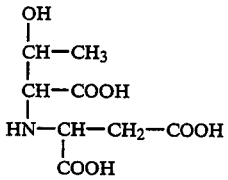
13.
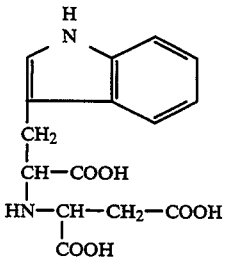
14.
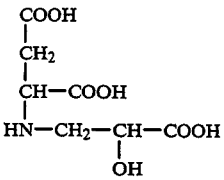

-continued
15.
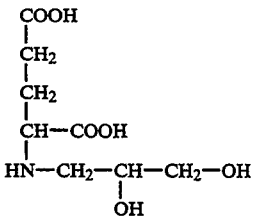
16.
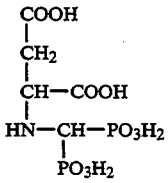
17.
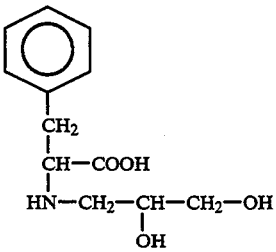
18.
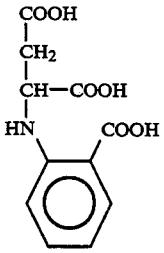
19.
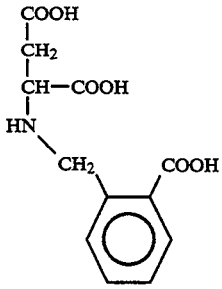
20.
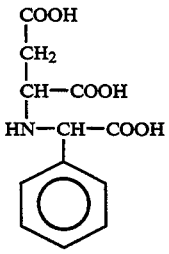
-continued
21.
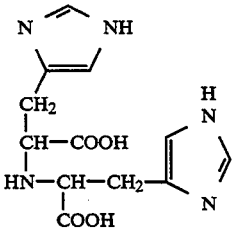
22.
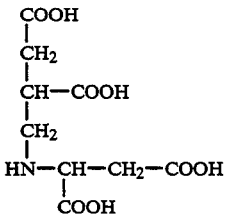
23.
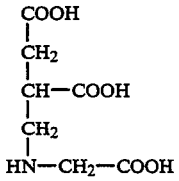
24.
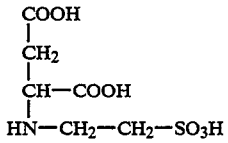
25.
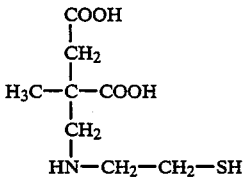
26.
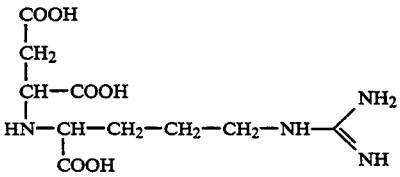
27.
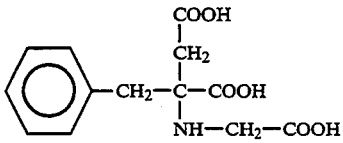
28.
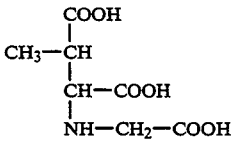
29.
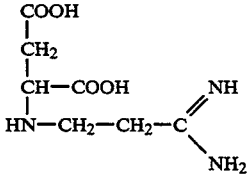

-continued

30.

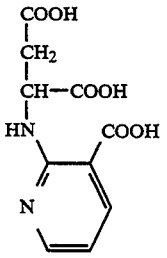

31.

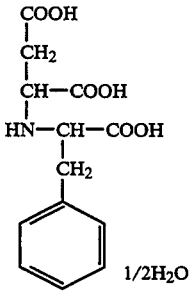

32.

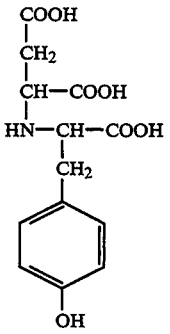

33.

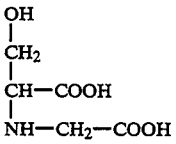

34.

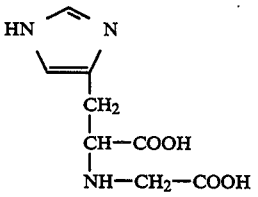

35.

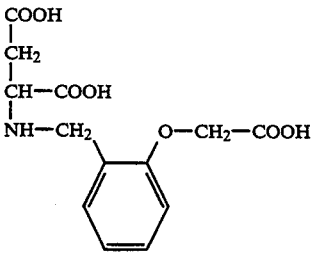

-continued

36.

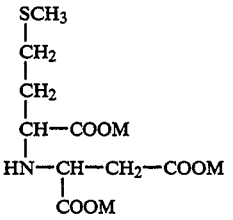

M: 2.5H, 0.5Na

Typical examples of the synthesis of the compound of the present invention are given below.

The compound of the present invention can be synthesized by the method for synthesis of aspartic-N-acetic acid as described in "Journal of Inorganic and Nuclear Chemistry", vol. 35, pp. 523–535, 1973, and Swiss Patent 561,504 or an analogous synthesis method.

SYNTHESIS EXAMPLE 1

Synthesis of Compound 1 (racemic modification)

3.0 g (0.04 mol) of glycine, 7.0 g (0.06 mol) of maleic acid, 10 ml of water, and 17.5 ml (0.123 mol) of a 7N aqueous solution of sodium hydroxide were heated under reflux with vigorous stirring in a three-necked flask over an oil bath for 15 hours. After cooling, the material was filtered. To the filtrate was then added 12.5 ml (0.123 mol) of concentrated hydrochloric acid. The resulting crystallized fumaric acid and maleic acid were then removed by filtration. The filtrate was then moved to a separating funnel. To the material was then added 50 ml of ethyl ether. The separating funnel was then thoroughly shaken. The resulting aqueous phase was then concentrated to 20 ml under reduced pressure. The resulting salts were then removed. The material was then adjusted to a pH value of 2.1 with a 5N aqueous solution of sodium hydroxide. The solution was then stored in a refrigerator for 2 days. The resulting crystal was recovered by filtration, washed with methanol and acetone, and then dried under reduced pressure to obtain 3.4 g ($1.78\times10^{-2}$ mol) of Compound 1. (Yield: 44%)

The chemical structure of the product was confirmed by NMR spectrum and elementary analysis. m.p.: 171°–174 ° C.

Elementary analysis: Calculated % for $C_6H_8NNaO_6 \cdot H_2O$: H4.36, C31.18, N6.06. Found %: H4.21, C30.98, N6.10.

$^1$H NMR ($D_2O$+NaOD) δppm δ 2.38–2.68 (m 2H) δ 3.30 (d 2H) δ 3.45–3.55 (m 1H)

SYNTHESIS EXAMPLE 2

Synthesis of Compound 1 (L modification)

100 g ($7.51\times10^{-1}$ mol) of L-aspartic acid, 107 g ($9.19\times10^{-1}$ mol) of sodium chloroacetate and 200 ml of water were thoroughly stirred in a three-necked flask. 198 g (2.42 mol) of a 48.93% aqueous solution of sodium hydroxide was added dropwise to the material while the internal temperature in the flask was kept at 45° to 50° C. in a hot water bath. During this procedure, the dropwise addition was controlled such that the pH value of the solution was kept at 8 to 9. When 5 hours had passed since the beginning of the dropwise addition, the reaction solution was moved to a beaker where it was then adjusted with concentrated hydrochloric acid to a pH value of 2.1. After being concentrated under reduced pressure, the resulting salts were removed by filtration. The filtrate was again concentrated under reduced pressure. The resulting salts were then removed by filtration. To the filtrate were then added 200 ml of methanol and 1 l of acetone. The resulting rubber-like material was thoroughly stirred.

The resulting supernatant liquid was then removed. To the rubber-like material were then added 200 ml of acetic acid and 200 ml of water. The material was then thoroughly stirred while the temperature thereof was kept at 70 ° C. in a hot water bath. After the deposition of a small amount of a crystal, the material was allowed to cool to room temperature where it was then allowed to stand for 1 hour. The resulting deposit was recovered by filtration. To the crystal thus obtained was added 50 ml of water. To the material was then added a 48–93 wt % aqueous solution of sodium hydroxide with stirring until the crystal was dissolved. The solution was then filtered. The filtrate was then adjusted with concentrated hydrochloric acid to a pH value of 2.1. After being allowed to stand overnight, the resulting crystal was then recovered by filtration to obtain 62.1 g ($2.69\times10^{-1}$ mol) of Compound 1. (Yield: 36%)

The chemical structure of the product was confirmed by NMR spectrum and elementary analysis. m.p.: 170°–171° C.

Elementary analysis: Calculated % for $C_6H_8NNaO_6$.-$H_2O$: H4.36, C31.18, N6.06. Found %: H4.24, C31.05, N6.04.

$^1$H NMR ($D_2O$+NaOD) δppm δ 3.02 (d 2H) δ 3.75 (m 2H) δ 4.00 (t 1H)

Angle of rotation $[\alpha]_D$27° C.=3.96° ($H_2O$)

SYNTHESIS EXAMPLE 3

Synthesis of Compound 5

10.0 g ($7.51\times10^{-2}$ mol) of L-aspartic acid, 10.5 g ($9.05\times10^{-2}$ mol) of maleic acid, 30 ml of water, and 13.2 g ($3.31\times10^{-1}$ mol) of sodium hydroxide were heated under reflux with vigorous stirring in a three-necked flask over an oil bath for 17 hours. After cooling to room temperature, the material was filtered. The filtrate was then adjusted with concentrated hydrochloric acid to a pH value of 1.4 to 1.5. The material was then stored in a refrigerator for 1 week. The resulting crystal was recovered by filtration, and then recrystallized from water to obtain 7.0 g ($2.63\times10^{-2}$ mol) of Compound 5. (Yield: 35%) m.p.: 201°–202° C.

Elementary analysis: Calculated % for $C_8H_{11}NO_8$.-$H_2O$: H4.90, C35-96, N5.24. Found %: H4.76, C35.75, N5.25.

$^1$H NMR ($D_2O$+NaOD) δppm 2.30–2.58 (m 4H) 3.40 (t 2H)

SYNTHESIS EXAMPLE 4

Synthesis of Compound 20

4.50 g ($2.98\times10^{-2}$ mol) of L-2--phenylglycine, 7.4 g ($1.50\times10^{-1}$ mol) of maleic acid, 100 ml of water, and 13.2 g ($3.30\times10^{-1}$ mol) of sodium hydroxide were heated under reflux with vigorous stirring in a three-necked flask over an oil bath for 60 hours. After cooling to room temperature, the material was filtered. The filtrate was then adjusted with concentrated hydrochloric acid to a pH value of 0.5. The resulting precipitate was then removed by filtration. The filtrate was then concentrated under reduced pressure until precipitation occurred. This procedure was repeated twice. To the concentrated solution was added 100 ml of acetone. The material was then thoroughly stirred. The material was then allowed to stand for 2 hours. The resulting salts were removed by filtration. The filtrate was then concentrated under reduced pressure to remove acetone therefrom. To the concentrated solution was then added a 5N aqueous solution of sodium hydroxide to adjust the pH thereof to 1.1. After being allowed to stand for 1 hour, the resulting crystal was recovered by filtration, and then recrystallized from a mixture of water and methanol to obtain 3.6 ($1.35\times10^{-2}$ mol) of Compound 20. (Yield: 45%)

Elementary analysis: Calculated % for $C_{12}H_{13}NO_6$: H4.90, C53.93, N5.24. Found %: H4.86, C53.78, N5.17.

$^1$H NMR ($D_2O$+NaOD) δppm δ 2.20–2.60 (m 2H) δ 3.05–3.45 (m 1H) δ 4.15–4.28 (d 1H) δ 7.25–7.60 (m 5H)

SYNTHESIS EXAMPLE 5

Synthesis of Compound 31

10.0 g ($6.05\times10^{-2}$ mol) of L-phenylalanine, 34.8 g ($3.00\times10^{-1}$ mol) of maleic acid, 200 ml of water, and 26.4 g ($6.60\times10^{-1}$ mol) of sodium hydroxide were heated under reflux with vigorous stirring in a three-necked flask over an oil bath for 60 hours. After cooling to room temperature, the material was filtered. The filtrate was then adjusted with concentrated hydrochloric acid to a pH value of 0.3. The resulting precipitate was then removed by filtration. The filtrate was then concentrated under reduced pressure until precipitation occurred. This procedure was repeated twice. To the concentrated solution was added 200 ml of acetone. The material was then thoroughly stirred. The material was then allowed to stand for 2 hours. The resulting salts were removed by filtration. The filtrate was then concentrated under reduced pressure to remove acetone therefrom. To the concentrated solution was then added a 5N aqueous solution of sodium hydroxide to adjust the pH thereof to 1.2. After being allowed to stand for 1 hour, the resulting crystal was recovered by filtration, and then recrystallized from a mixture of water and acetone to obtain 6.6 g ($2.27\times10^{-2}$ mol) of Compound 31. (Yield: 38%) m.p.: 197°–198° C. (decomposition)

Elementary analysis: Calculated % for $C_{13}H_{15}NO_6\cdot\frac{1}{2}H_2O$: H5.56, C53.79, N4.83. Found %: H5.48, C53.68, N4.77.

$^1$H NMR ($D_2O$+NaOD) δppm δ 2.45–2.72 (m 2H) δ 2.90–3.25 (m 2H) δ 3.50–3.62 (m 1H) δ 3.65–3.85 (m 1H) δ 7.20–7.50 (m 5H)

SYNTHESIS EXAMPLE 6

Synthesis of Compound 32

10.0 g ($5.52\times10^{-2}$ mol) of L-tyrosine, 32.0 g ($2.76\times10^{-1}$ mol) of maleic acid, 200 ml of water, and 26.5 g ($6.63\times10^{-1}$ mol) of sodium hydroxide were heated under reflux with vigorous stirring in a three-necked flask over an oil bath for 60 hours. After cooling to room temperature, the material was filtered. The filtrate was then adjusted with concentrated hydrochloric acid to a pH value of 5.2. The resulting precipitate was then removed by filtration. To the filtrate was added 200 ml of acetone. The material was thoroughly stirred for 1 hour. The resulting precipitate was then removed by filtration. The filtrate was then concentrated under reduced pressure. To the concentrated solution was added concentrated hydrochloric acid to adjust the pH value thereof to 1.2. The material was then allowed to stand overnight. The resulting crystal was recovered by filtration, and then washed with water and acetone to obtain 5.6 g ($1.88\times10^{-2}$ mol) of Compound 32. (Yield: 34)

Elementary analysis: Calculated % for $C_{13}H_{15}NO_7$: H5.09, C52.53, N4.71. Found %: H5.01, C52.38, N4.64.

$^1$H NMR ($D_2O$+NaOD) δppm δ 2.40–2.60 (m 2H) δ 2.85–3.10 (m 2H) δ 3.45–3.60 (m 2H) δ 6.70–6.85 (d 2H) δ 7.05–7.25 (d 2H)

SYNTHESIS EXAMPLE 7

Synthesis of Compound 2

100 g (0.5 mol) of 20% sodium hydroxide aqueous solution was added to 50 g (0.267 mol) of L(+)-sodium glutamate monohydrate, 61.8 g (0.334 mol) of glyoxylic acid solution (ca 40% in water) with stirring in a beaker over an ice bath. The material was adjusted with water to prepare about 210 ml solution having a pH value of 7. After being subjected to catalytic hydrogenation using 2 g of 10% Pd/C, the material was filtered by Celite. The filtrate was concentrated to 100 ml under reduced pressure and then adjusted with 36% hydrochloric acid to a pH value of 2. After stirring for an hour, the resulting crystal was recovered by filtration, and then recrystallized from hot water to obtain 15.4 g (0.075 mol) of Compound 2. (Yield 28.1 %)

Elementary analysis: Calculated % for $C_7H_{11}NO_6$: H5.40, C40.98, N6.83. Found %: H5.32, C40.85, N6.89.

$^1$H NMR ($D_2O$+NaOD) δppm δ 1.65–2.00 (m 2H) δ 2.05–2.30 (m 2H) δ 2.90–3.20 (m 3H)

SYNTHESIS EXAMPLE 8

Synthesis of Compound 9

10.48 g (0.02 mol) of L-histidine monohydrochloride (monohydrate), 16.0 g (0.1 mol) of disodium maleate, 4 g (0.1 mol) of sodium hydroxide and 40 ml of water were heated under reflux with vigorous stirring in a three-necked flask over an oil bath for 48 hours. After cooling to room temperature, the material was filtered. The filtrate was then adjusted with 36% hydrochloric acid to a pH value of 3. The resulting precipitation was removed by filtration and adjusted to a pH value of 1.4. After being allowed to stand overnight, the resulting crystal was recovered by filtration, and then recrystallized from hot water to obtain 3.69 g (0.013 mol) of ½ hydrate of Compound 9. (Yield: 26.3%) m.p.: 203°–204° C. (decomposition)

Elementary analysis: Calculated % for $C_{10}H_{13}N_3O_6$: H5.03, C42.86, N14.99. Found %: H5.15, C42.77, N19.86.

$^1$H NMR ($D_2O$+NaOD) δppm δ 2.40–2.60 (m 2H) δ 2.71–3.00 (m 2H) δ 3.25–3.50 (m 2H) δ 6.75–6.95 (m 1H) δ 7.60 (s 2H)

SYNTHESIS EXAMPLE 9

Synthesis of Compound 36

14.9 g (0.1 mol) of D,L-methionine, 32.0 g (0.2 mol) of disodium maleate, 4 g (0.1 mol) of sodium hydroxide and 60 ml of water were heated under reflux with vigorous stirring in a three-necked flask over an oil bath for 48 hours. After cooling to room temperature, the material was filtered. The filtrate was then adjusted with 36% hydrochloric acid to a pH value of 3. The resulting precipitation was removed by filtration and adjusted to a pH value of 1.4. After being allowed to stand overnight, the resulting crystal was recovered by filtration, and then recrystallized from hot water to obtain 8.37 g (0.03 mol) of Compound 36. (Yield: 30.3%) m.p.: 181°–183° C. (decomposition)

Elementary analysis: Calculated % for $C_9H_{14.5}NNa_{0.5}O_6S$: H5.29, C39.13, N5.07, S11.61. Found %: H5.28, C38.74, N5.02, S11.28.

$^1$H NMR ($D_2O$+NaOD) δppm δ 1.80–2.00 (m 2H) δ 2.12 (s 3H) δ 2.23–2.68 (m 4H) δ 3.15–3.25 (m 1H) δ 3.32–3.48 (m 1H)

SYNTHESIS EXAMPLE 10

Synthesis of Compound 18

10.0 g (0.073 mol) of anthranilic acid, 18.24 g (0.093 mol) of 2-bromosuccinic acid and 50 ml of water were stirring at 50° C. for 6 hours in a three-necked flask over an oil bath while the pH value of the material was kept 9 by adding 20% sodium hydroxide aqueous solution. After the reaction, the material was adjusted with 36% hydrochloric acid to a pH value of 2. The resulting brown precipitation was dissolved in acetone and water and treated with activated carbon. By removing acetone under reduced pressure, the crystal was precipitated. The resulting crystal was filtered to obtain 9.86 g (0.04 mol) of Compound 18. (Yield: 53.4%) m.p.: 191°–192° C. (decomposition)

Elementary analysis: Calculated % for $C_{11}H_{11}NO_6O$: H4.38, C52.18, N5.53. Found %: H4.44, C52.12, N5.53.

$^1$H NMR ($D_2O$+NaOD) δppm δ 2.40–2.88 (m 2H) δ 4.10–4.30 (q 1H) δ 6.55–6.85 (m 2H) δ 7.28–7.45 (m 1H) δ 7.67–7.95 (m 1H)

SYNTHESIS EXAMPLE 11

Synthesis of Compound 33

25 g (0.238 mol) of L-serine, 27.71 g (0.238 g) of sodium chloroacetate, 20% sodium hydroxide aqueous solution and water was added to a three-necked flask to prepare about 500 ml solution having a pH value of 9. After being reacted at 40° C. for 8 hours with vigorous stirring over an oil bath, the material was adjusted with 36% hydrochloric acid to a pH value of 7 and then condenced under reduced pressure. The desired product was uptaken by a cation exchange column chromatography and then eluted with water. The eluate was condenced. After being allowed to stand overnight, the resulting crystal was recovered by filtration to obtain 7.14 g (0.044 mol) of Compound 33. (Yield: 18.4%). m.p.: 173°–174° C. (decomposition)

Elementary analysis: Calculated % for $C_5H_9NO_5$: H5.56, C36.81, N8.59. Found %: H5.42, C36.61, N8.61.

$^1$H NMR ($D_2O$+NaOD) δppm δ 3.03–3.35 (m 3H) δ 3.10–3.85 (m 2H)

SYNTHESIS EXAMPLE 12

Synthesis of Compound 34

20% sodium hydroxide aqueous solution and water were added to 50 g (0.238 mol) of L-histidine monohydrochloride (monohydrate), 53.0 g (0.268 mol) of glyoxylic acid solution (ca 40% in water) with stirring in a beaker over an ice bath to prepare about 200 ml solution having a pH value of 7. After being subjected to catalytic hydrogenation using 2 g of 10% Pd/C, the material was filtered through Celite. The filtrate was concentrated to 100 ml under reduced pressure. The resulting precipitation was recovered by filtration, and then recrystallized from hot water to obtain 17.0 g (0.08 mol) of Compound 34. (Yield 33.5%)

Elementary analysis: Calculated % for $C_8H_{11}N_3O_4$: H5.20, C45.07, N19.71. Found %: H5.15, C44.88, N19.62.

$^1$H NMR ($D_2O$+NaOD) δppm δ 2.78–3.00 (m 2H) δ 3.01–3.20 (q 2H) δ 3.25–3.37 (m 1H) δ]6.88 (s 1H) δ 7.65 (s 1H)

SYNTHESIS EXAMPLE 13

Synthesis of Compound 35

59 g (0.295 mol ) of 20% sodium hydroxide aqueous solution was added to 12.7 g (0.095 mol) of L-asparatic acid, 18.92 g (0.105 mol ) of 2-formylphenoxyacetic acid with stirring in a beaker over an ice bath. The material was adjusted with water to prepare about 200 ml. After being subjected to catalytic hydrogenation using 2 g of 10% Pd/C, the material was filtered through Celite. The filtrate was concentrated to 100 ml under reduced pressure and then adjusted with 36% hydrochloric acid to a pH value of 3. After stirring for an hour, the resulting crystal was recovered by filtration, and then washed with acetone to obtain 23.46 g (0.08 mol) of Compound 35. (Yield 83.1%)

Elementary analysis: Calculated % for $C_{13}H_{15}NO_7$: H5.09, C52.53, N4.71. Found %: H4.92, C51.93, N4.69.

$^1$H NMR ($D_2O$+NaOD) δppm δ 2.27–2.61 (m 2H) δ 3.37–3.50 (q 1H) δ 3.65–3.88 (q 2H) δ 6.75–6.88 (d 1H) δ 6.92–7.10 (t 1H) δ 7.20–7.40 (t 2H)

The other compounds of the present invention are synthesized similarly.

The metallic salt which constitutes the metal chelate compound of the present invention is selected from the group consisting of Fe(III), Mn(III), Co(III), Rh(II), Rh(III), Au(II), Au(III) and Ce(IV) salts. Preferred Among these metallic salts are Fe(III), Mn(III), and Ce(IV) salts. Particularly preferred among these metallic salts are Fe(III) salts (e.g., ferric sulfate, ferric chloride, ferric nitrate, ferric ammonium sulfate, ferric phosphate).

The metal chelate compound of the present invention may be prepared and isolated prior to addition to the processing solution. Alternatively, the compound represented by formula (I) and the foregoing metallic salt may be allowed to react with each other in the processing solution. Similarly, an ammonium salt or alkaline metal salt (e.g., lithium salt, sodium salt, potassium salt) of the compound represented by formula (I) and the foregoing metallic salt may be allowed to react with each other in the processing solution.

The compound represented by formula (I) is used in a proportion of 1.0 mol or more per mol of the metal ion. The molar proportion of the compound represented by formula (I) to the metal ion is preferably increased if the stability of the metal chelate compound is low. The molar proportion is generally in the range of 1 to 30.

Specific examples and synthesis examples of the metal chelate compound of the present invention are given below, but the metal chelate compound of the present invention should not be construed as being limited thereto to the extent that it is a complex formed by the foregoing compound represented by formula (I) and the foregoing metal salt.

K-1

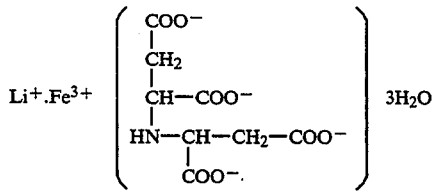

K-2

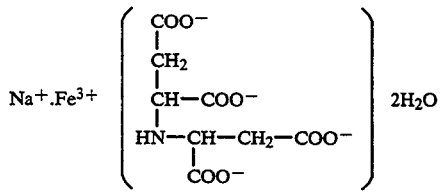

K-3

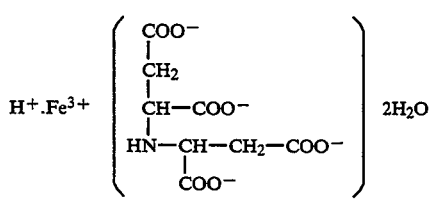

K-4

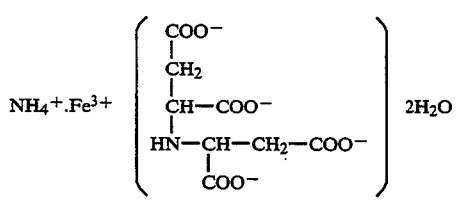

K-5

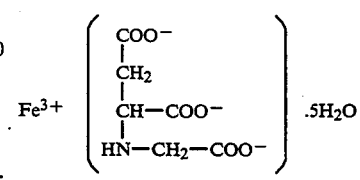

K-6

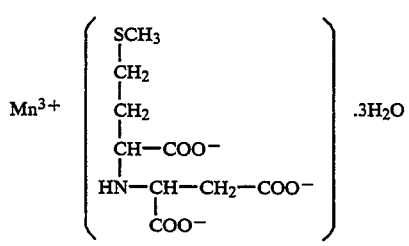

K-7

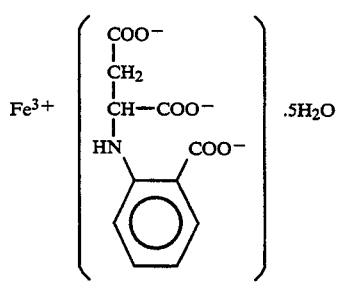

SYNTHESIS EXAMPLE 3

Synthesis of Compound K-2

23.0 g ($8.61\times10^{-2}$ mol) of Compound 5 synthesized in Synthesis Example 2 was suspended in 23 ml of water. To the suspension was then added 51.7 ml ($2.58\times10^{-1}$ mol) of a 5N aqueous solution of sodium hydroxide to make a solution. The solution was then added dropwise to 35 ml of an aqueous solution containing 34.8 g ($8.61\times10^{-2}$ mol) of ferric nitrate nonahydrate with vigorous stirring. The material was then stirred for 30 minutes while the temperature thereof was kept to 70 ° C. over a hot water bath. The material was then filtered. The solvent was distilled off under reduced pressure to concentrate the solution to about ⅓ of its volume. The material was then allowed to stand at room temperature for 2 weeks. The resulting crystal was recovered by filtration, washed with water and acetone, and then dried to obtain 21.1 g ($5.85\times10^{-2}$ mol) of Compound K-2 in the form of yellow solid. (Yield: 68 %)

Elementary analysis: Calculated % for $C_8H_7FeNNaO_8.2H_2O$: H3.08, C26.69, N3.89. Found %: H3.14, C26.58, N3.83.

Fe(III), Mn(III), Co(III), Rh(II), Rh(III), Au(II), Au(III) or Ce(IV) chelate compounds of the compound represented by the general formula (I) or salts thereof (hereinafter simply referred to as "metal chelate compounds of the present invention") function as an oxidizer for silver halide photographic materials (particularly a bleaching agent for color photographic light-sensitive materials).

In accordance with a preferred embodiment of the processing composition containing the metal chelate compound of the present invention, a silver halide color photographic material which has been imagewise exposed to light and color-developed can be processed with a processing solution having a bleach capacity containing at least the metal chelate compound of the present invention as a bleaching agent. The inventive processing composition provides extremely rapid bleaching of developed silver without causing remakable bleach fog that is found with the prior art rapid bleaching agents.

The present invention is characterized by an oxidizer incorporated in a photographic processing composition, particularly a bleaching agent be incorporated in a processing composition having a bleaching capacity for processing a color photographic light-sensitive material. The processing composition of the present invention can contain known additives commonly employed in bleaching compositions without particular limitation.

The processing solution containing the metal chelate compound of the present invention is described in further detail below.

The metal chelate compound of the present invention may be added to those processing solutions where an oxidizer is needed (e.g., a fixing solution, an intermediate bath between color development and desilvering). The metal chelate compound of the present invention is effectively added in an amount of from 0.005 to 1 mol per l of processing solution to provide a reducer for black-and-white photographic materials or a processing solution (bleaching solution or blix solution) having a bleaching capacity for a color photographic material.

Preferred embodiments of the processing solution having a bleaching capacity are described below. As mentioned above, the metal chelate compound of the present invention can be added to a processing solution having a bleaching capacity in an amount of 0.005 to 1 mol, more preferably 0.01 to 0.5 mol, particularly 0.05 to 0.5 mol per l of processing solution, to serve as an effective bleaching agent. The metal chelate compound of the present invention can exert its excellent effects even at a concentration as low as 0,005 to 0.2 mol, preferably 0.01 to 0.2 mol, more preferably 0.05 to 0.18 mol per l of processing solution.

If the metal chelate compound of the present invention is incorporated in a processing solution having a bleaching capacity as a bleaching agent, it may be used in combination with other bleaching agents so long as the effects of the present invention are obtained (preferably 0.01 mol or less, preferably 0.005 mol or less of other bleaching agents per l of processing solutions. Examples of such bleaching agents include Fe(III), Co(III) or Mn(III) chelates of the compounds described below, persulfates (e.g., peroxodisulfates), hydrogen peroxide, and bromates.

Examples of compounds which can forth the foregoing chelate bleaching agents include ethylenediaminetetraacetic acid, diethylenetriaminepentaacetic acid, ethylenediamine-N-(β-hydroxyethyl)-N,N',N'-triacetic acid, 1,2-diaminopropanetetraacetic acid, 1,3-diaminopropanetetraacetic acid, nitrilotricetic acid, cyclohexanediaminetetraacetic acid, iminodiacetic acid, dihydroxyethylglycine, ethyletherdiaminetetraacetic acid, glycoletherdiaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, nitrilodiacetomonopropionic acid, nitrilomonoacetodipropionic acid, 2-hydroxy-3-aminopropionate-N,N-diacetic acid, serine-N,N-diacetic acid, 2-methyl-serine-N,N-diacetic acid, 2-hydroxymethyl-serine-N,N-diacetic acid, hydroxyethyliminodiacetic acid, methyliminodiacetic acid, N-(2-acetamide)-iminodiacetic acid, nitrilotripropionic acid, ethylenediaminediacetic acid, ethylenediaminedipropionic acid, 1,4-diaminobutanetetraacetic acid, 2-methyl-1,3-diaminopropanetetraacetic acid, 2-dimethyl-1,3-diaminopropanetetraacetic acid, citric acid, and alkali metal salts (e.g., lithium salt, sodium salt, potassium salt) and ammonium salts thereof. Further examples of chelate-forming compounds include the bleaching agents described in JP-A-63-80256, JP-A-63-97952, JP-A-63-97953, JP-A-63-97954, JP-A-1-93740, JP-A-2-216650, JP-A-3-180842, JP-A-4-73645, JP-A-4-73647, JP-A-4-127145, JP-A-4-134450, and JP-A-4-174432, European Patent Application 430000A1, and West German Patent Application (OLS) 3912551.

The processing solution having a bleaching capacity containing the metal chelate compound of the present invention preferably contains a halide such as a chloride, bromide and iodide as a rehalogenating agent for accelerating the oxidation of silver in addition to the metal chelate compound as a bleaching agent. Instead of such a halide, an organic ligand for forming a sparingly soluble salt may be added to the system. The halide may be added in the form of alkali metal salt or ammonium salt, or a salt such as guanidine and amine. Examples of such a salt include sodium bromide, ammonium bromide, potassium chloride, guanidine hydrochloride, potassium bromide, and potassium chloride. The content of the rehalogenating agent in the processing solution of the present invention having a bleaching capacity is preferably in the range of 2 mol/l or less. If the processing solution is a bleaching solution, the content of the rehalogenating agent is preferably in the range of 0.01 to 2.0 mol/l, more preferably 0.1 to 1.7 mol/l, particularly 0.1 to 0.6 mol/l. If the processing solution is a blix solution, the content of the rehalogenating agent is preferably in the range of 0.001 to 2.0 mol/l, more preferably 0.001 to 1.0 mol/l, particularly 0.001 to 0.5 mol/l.

The bleaching solution or blix solution of the present invention may further comprise a bleach accelertor, a corrosion inhibitor for inhibiting corrosion of processing bath, a buffer for maintaining the desired pH value of the processing solution, a fluorescent brightening agent, an anti-foaming agent, etc. as needed.

Examples of the bleach accelerator for use in the present invention includes mercapto- or disulfide-containing compounds as disclosed in U.S. Pat. No. 3,893,858, German Patent 1,290,812, British Patent 1,138,842, JP-A-53-95630, and Research Disclosure No. 17129 (1978), thiazolidine derivatives as disclosed in JP-A-50-140129, thiourea derivatives as disclosed in U.S. Pat. No. 3,706,561, iodides as disclosed in JP-A-58-16235, polyethylene oxides as disclosed in German Patent 2,748,430, polyamine compounds as disclosed in JP-B-45-8836, and imidazole compounds as disclosed in JP-A-49-40493. Particularly preferred among these bleach accelerators are mercapto compounds as disclosed in British Patent 1,138,842.

Preferred examples of the corrosion inhibitor include nitrates such as ammonium nitrate, sodium nitrate and potassium nitrate. The nitrate can be added in an amount of from 0.01 to 2.0 mol/l, preferably 0.05 to 0.5 mol/l.

The pH value of the bleaching solution or blix solution of the present invention is in the range of from 2.0 to 8.0, preferably 3.0 to 7.5. If a photographic light sensitive material for picture taking is subjected to bleaching or blix shortly after color development, the pH value of the processing solution is preferably in the range of 7.0 or less, more preferably 6.4 or less, to inhibit bleach fog. In particular, if the processing solution is used as a bleaching solution, its pH value is preferably in the range of from 3.0 to 5.0. If the pH value of the processing solution is in the range of 2.0 or less, the resulting metal chelate compound of the present invention tends to become unstable. Thus, the pH value of the processing solution is preferably in the range of from 2.0 to 6.4. For color printing materials, the pH value of the processing solution is preferably in the range of from 3 to 7.

Useful pH buffers for this purpose compounds which are not susceptible to oxidation by a bleaching agent and have a buffer capacity in the above specified pH range. Examples of the pH buffer include organic acids such as acetic acid, glycolic acid, lactic acid, propionic acid, butyric acid, malic acid, chloroacetic acid, levulinic acid, ureidopropionic acid, formic acid, monobromoacetic acid, monochloropropionic acid, pyruvic acid, acrylic acid, isobutyric acid, pivalic acid, aminobutyric acid, valetic acid, isovaleric acid, aspattic acid, alanine, arginine, ethionine, glycine, glutamine, cysteine, serine, methionine, leucine, histidine, benzoic acid, chlorobenzoic acid, hydroxybenzoic acid, nicotinic acid, oxalic acid, malonic acid, succinic acid, tartaric acid, maleic acid, fumaric acid, oxalacetic acid, glutaric acid, adipic acid, aspartic acid, glutamic acid, cystine, ascorbic acid, phthalic acid and terephthalic acid, and organic bases such as pyridine, dimethylpyrazole, 2-methyl-o-oxazoline, aminoacetonitrile and imidazole. A plurality of these pH buffers may be used in combination. In the present invention, an organic acid having a pKa of from 2.0 to 5.5 is preferably used. In particular, acetic acid and glycolic acid are preferably used, singly or in combination. These organic acids may be used in the loren of an alkali metal salt (e.g., lithium salt, sodium salt, potassium salt) or an ammonium salt. The addition amount of the pH buffer is in the range of 3.0 mol or less, preferably 0.1 to 2.0 mol, more preferably 0.2 to 1.8 mol, particularly 0.4 to 1.5 mol per l of processing solution.

In order to adjust the pH value of the processing solution having a bleaching capacity to the above specified range, the foregoing acid may be used in combination with an alkaline agent (e.g., aqueous ammonia, KOH, NaOH, potassium carbonate, sodium carbonate, imidazole, monoethanolamine, diethanolamine). Particularly preferred among these alkaline agents are aqueous ammonia, KOH, NaOH, potassium carbonate, and sodium carbonate.

Due to the recent growing awareness of the need to protect the global environment, efforts have been made to reduce the amount of nitrogen discharged to the atmosphere. From this standpoint, the processing solution of the present invention is desirably substantially free of ammonium ion.

The expression "substantially free of ammonium ion" as used herein means an ammonium ion concentration in the range of 0.1 mol/l or less, preferably 0.08 mol/l or less, more preferably 0.01 mol/l or less, particularly none.

In order to reduce the ammonium ion concentration to the above specified range, useful substitute cations preferably include alkali metal ions or alkaline earth metal ions, particularly alkali metal ions, specifically lithium ion, sodium ion or potassium ion. Examples of such a compound include sodium or potassium salts of a ferric complex of an organic acid as a bleaching agent, potassium bromide or sodium bromide as a rehalogenating agent for addition to the processing solution having a bleaching capacity, potassium nitrate, and sodium nitrate.

Preferred examples of the alkaline agent used for pH adjustment include potassium hydroxide, sodium hydroxide, potassium carbonate, and sodium carbonate.

The processing solution of the present invention having a bleaching capacity is preferably subjected to aeration during processing to provide maximum stabilization of photographic properties. The aeration can be effected by methods known in the art. For example, air may be blown into the processing solution having a bleaching capacity, or air may be absorbed by means of an ejector.

In order to blow air into the processing solution, air is preferably discharged into the solution through an air diffusing tube having micropores. Such an air diffusing tube is widely used in aeration baths for active sludge treatment, etc. For the details of aeration, reference can be made to Eastman Kodak's technical report Z-121 "Using Process C-41", 3rd edition, 1982, pp, BL-1 - BL-2. In processing with the processing solution of the present invention having a bleaching capacity, agitation is preferably intensified. For its implementation, reference can be made to JP-A-3-33847, line 6, upper right column to line 2, lower left column, page 8.

Bleaching or blix may be effected at a temperature of 30 ° C. to 60 ° C., preferably 35 ° C. to 50 ° C.

Bleaching and/or blix may be effected for 10 seconds to 7 minutes, preferably 10 seconds to 4 minutes for picture-taking photographic light-sensitive materials. For printing photographic light-sensitive materials, bleaching and/or blix may be effected for 5 seconds to 70 seconds, preferably 5 seconds to 60 seconds, more preferably 10 seconds to 45 seconds. Under these desirable conditions, rapid processing can be effected with excellent results without causing an increase in staining.

The photographic light-sensitive material for processing with the processing solution having a bleach capacity is then subjected to fixing or blix treatment. If the processing solution having a bleaching capacity is a blix solution, the blix procedure may or may not be followed by fixing or blix treatment. For a preferred example of such a fixing or blix solution, reference can again be made to JP-A-3-33847, line 16, lower right column, page 6 - line 15, upper left column, page 8.

A fixing agent for general use in the desilvering procedure is ammonium thiosulfate. Instead of ammonium thiosulfate, other known fixing agents such as a mesoionic compound, a thioether compound, thiourea, iodine (if used in large amount) and hypo may be used. For these fixing agents, reference can be made to JP-A-60-61749, JP-A-60-147735, JP-A-64-21444, JP-A-1-201659, JP-A-1-210951, and JP-A-2-44355, and U.S. Pat. No. 4,378,424. Examples of the fixing agent include ammonium thiosulfate, sodium thiosulfate, potassium thiosulfate, guanidine thiosulfate, ammonium thiocyanate, sodium thiocyanate, potassium thiocyanate, dihydroxyethyl-thioether, 3,6-dithia-1,8-octanediol, and imidazole. Preferred among these fixing agents are thiosulfates and mesoions. For rapid fixing, ammonium thiosulfate is preferred. However, in order to provide a processing solution substantially free of ammonium ion in consideration of the environment as discussed above, sodium thiosulfate or mesoions are further preferred. Moreover, two or more kinds of fixing agents may be used in combination to provide faster fixing. For example, in addition to ammonium thiosulfate or sodium thiosulfate, the foregoing ammonium thiocyanate, imidazole, thiourea, thioether, etc. may be used. In this case, the second fixing agent is preferably used in an amount of 0.01 to 100 mol % based on the weight of ammonium thiosulfate or sodium thiosulfate.

The addition amount of the fixing agent is in the range of from 0.1 to 3.0 mol, preferably 0.5 to 2.0 mol per l of the fixing or blix solution. The pH value of the fixing solution depends on the kind of the fixing solution, but is generally in the range of from 3.0 to 9.0. In particular, if a thiosulfate is used, the pH value of the fixing solution is preferably in the range of from 5.8 to 8.0 to provide stable fixing properties.

The fixing or blix solution may comprise a preservative to enhance the ageing stability thereof. In the case of a fixing or blix solution containing a thiosulfate, effective preservatives include a sulfite and/or bisulfite adduct of hydroxylamine, hydrazine or aldehyde (e.g., bisulfite adduct of acetaldehyde, particularly bisulfite adduct of aromatic aldehyde as disclosed in JP-A-1-298935). Further, the sulfinic compounds as disclosed in JP-A-62-143048 are preferably used.

The fixing or blix solution may preferably comprise a buffer to maintain the pH value thereof constant. Examples of the pH buffer include phosphates, imidazoles such as imidazole, 1-methyl-imidazole, 2-methyl-imidazole and 1-ethyl-imidazole, triethanolamine, N-allylmorpholine and N-benzoylpiperadine.

Furthermore, the fixing solution may comprise various chelating agents to mask iron ions carried over from the bleaching bath to enhance the stability thereof. Preferred examples of such chelating agents include 1-hydroxyethylidene-1,1-diphosphonic acid, nitrilotrimethylenephosphonic acid, 2-hydroxy-1,3-diaminopropanetetraacetic acid, ethylenediaminetetraacetic acid, diethylenetriaminepentaacetic acid, ethylenediamine-N-(β-oxyethyl)-N,N,N-triacetic acid, 1,2-diaminopropanetetraacetic acid, 1,3-diaminopropanetetraacetic acid, nitrilotriacetic acid, cyclohexanediaminetetraacetic acid, iminodiacetic acid, dihydroxyethylglycihe, ethyletherdiaminetetraacetic acid, glycoletherdiaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, serine-N,N-diacetic acid, 2-methyl-serine-N,N-diacetic acid, 2-hydroxymethyl-serine-N,N-diacetic acid, hydroxyethyliminodiacetic acid, methyliminodiacetic acid, N-(2-acetamide)-iminodiacetic acid, nitrilotripropionic acid, ethylenediaminediacetic acid, ethylenediaminedipropionic acid, 1,4-diaminobutanetetraacetic acid, 2-methyl-1,3-diaminopropanetetraacetic acid, 2-dimethyl-1,3-diaminopropanetetraacetic acid, alanine, hydrazidediacetic acid, N-hydroxy-iminodipropionic acid, and alkali metal salts (e.g., lithium salt, sodium salt, potassium salt) or ammonium salts thereof.

The fixing procedure may be effected at a temperature of from 30 ° C. to 60 ° C., preferably 35 ° C. to 50 ° C.

The fixing procedure is effected for 15 seconds to 2 minutes, preferably 25 seconds to 100 seconds for picture-taking photographic light-sensitive materials. For printing photographic light-sensitive materials, fixing is effected for 8 secons to 80 seconds, preferably 10 seconds to 45 seconds.

The desilvering procedure normally comprises bleaching, blixing and fixing in combination. Specific examples thereof a include the following combinations:

1. Bleaching - fixing
2. Bleaching - blixing
3. Bleaching - blixing - fixing
4. Bleaching - rinsing - fixing
5- Blixing
6. Fixing - blixing For picture-taking photographic light-sensitive materials, Combination 1, 2, 3 or 4 are preferably employed, more preferably 1, 2 or 3. For printing photographic light-sensitive materials, Combination 5 is preferred.

The present invention may also be applied to a desilvering procedure effected via, e.g., adjustment, a stop bath, rinsing, etc. after color development.

The processing procedure of the present invention is preferably effected by means of an automatic developing machine. For the conveying means in such an automatic developing machine, reference can be made to JP-A-60-191257, JP-A-60-191258, and JP-A-60-191259. In order to provide rapid processing, the crossover between processing baths in the automatic developing machine is preferably shortened. An automatic developing machine having a crossover time of 5 seconds or less is disclosed in JP-A-1-319038.

When such an automatic developing machine is used to effect continuous processing in accordance with the processing method of the present invention, a replenisher is preferably added to the system depending on the processed amount of the photographic light-sensitive material to compensate for the loss of components of the processing solution accompanied by the processing of the photographic light-sensitive material, and to inhibit the accumulation of undesirable components eluted from the photographic light sensitive material into the processing solution. Each processing procedure typically comprises two or more processing baths. In this arrangement, a countercurrent process is preferably used in which a replenisher flows from the post bath to the prebath. In particular, the rinsing procedure or stabilizing procedure is preferably effected in a 2- to 4-stage cascade arrangement.

The amount of the replenisher is preferably minimized, unless a change in the composition of each processing solution adversely affects the photographic properties or contaminates the processing solution.

The amount of the color developer replenisher is in the range of from 50 ml to 3,000 ml, preferably 50 ml to 2,200 ml per $m^2$ of light-sensitive material processed for color picture-taking photographic light-sensitive materials. For color printing photographic light-sensitive materials, the replenishment amount is in the range of from 15 ml to 500 ml, preferably 20 ml to 350 ml per $m^2$ of light-sensitive material processed.

The amount of the bleaching solution replenisher is in the range of from 10 ml to 1,000 ml, preferably 50 ml to 550 ml per $m^2$ of light-sensitive material processed for color picture-taking photographic light-sensitive materials. For color printing photographic light-sensitive materials, the replenishment amount is in the range of from 15 ml to 500 ml, preferably 20 ml to 300 ml per $m^2$ of light-sensitive material processed.

The amount of the blix solution replenisher is in the range of from 200 ml to 3,000 ml, preferably 250 ml to 1,300 ml per $m^2$ of the light-sensitive material processed for color picture-taking photographic light-sensitive materials. For color printing photographic light-sensitive materials, the replenishment amount is in the range of from 20 ml to 300 ml, preferably 50 ml to 200 ml per $m^2$ of the light-sensitive material processed. The blix solution replenisher may be supplied as a single-solution or may be separately supplied as a bleach composition and a fixing composition. Alternatively, the blix solution may be mixed with an overflow solution from the bleaching bath and/or fixing bath to provide a blix solution replenisher.

The amount of the fixing solution replenisher is in the range of from 300 ml to 3,000 ml, preferably 300 ml to 1,200 ml per $m^2$ of the light-sensitive material processed for color picture-taking photographic light-sensitive materials. For color printing photographic light-sensitive materials, the replenishment amount is in the range of from 20 ml to 300 ml, preferably 50 ml to 200 ml per $m^2$ of light-sensitive material processed.

The replenishment rate of the rinsing solution or stabilizing solution is 1 to 50 times, preferably 2 to 30 times, more preferably 2 to 15 times the amount of the processing solution carried over from the prebath per unit area of the photographic material.

The overflow solution from the processing bath of the present invention having a bleaching capacity may be recovered, and then corrected for composition for re-use. This recycling is called regeneration. In the present invention, such regeneration is preferably carried at. For the details of regeneration, reference can be made to Fuji Photo Film Co., Ltd.'s technical report "Fuji Film Processing Manual: Fuji Color Negative Film, CN-16 Processing", revised August 1990, pp. 39–40.

The kit from which the processing solution of the present invention having a bleaching capacity is prepared may be in the form of a liquid or powder. If ammonium salts are excluded, most materials can be supplied in the form of a powder. Furthermore, since such a kit is not hygroscopic, a powder is easily prepared.

The foregoing kit for regeneration is preferably provided in the form of a powder which can be used as is without adding any extra water in order to reduce the amount of waste liquid.

The regeneration of the processing solution having a bleaching capacity can be accomplished by the foregoing aeration as well as by the method disclosed in "Shashin Kogaku no Kiso - Ginenshashinhen (Principle of Photographic Engineering: Silver Salt Photography)", Society of Photographic Science and Technology of Japan, Corona, 1979. Specific examples of such a regeneration method include electrolytic regeneration, and regeneration of the bleaching solution with hydrogen peroxide, bromous acid, ozone, etc. utilizing bromic acid, chlorous acid, bromine, bromine precursor, persulfate, hydrogen persulfate, catalyst, etc.

In the electrolytic regeneration, a cathode and an anode may be provided within the same bleach bath. Alternatively, a membrane may be used to partition a compartment into an anode compartment and a cathode compartment. A membrane may also be used to regenerate the bleaching solution and the developer and/or fixing solution at the same time.

The regeneration of the fixing solution or blix solution can be accomplishd by the electrolytic reduction of accumulated silver ion. Further, accumulated halogen ion is preferably removed through an anion exchange resin to maintain the desired fixing properties.

In order to reduce the amount of rinsing water, ion exchange or ultrafiltration may be effected. In particular, ultrafiltration is preferred.

In the present invention, the color photographic light-sensitive material which has been imagewise exposed to light is subjected to color development before desilvering. Examples of the color developer for use in the present invention include those disclosed in JP-A-3-33847, line 6, upper left column, page 9 - line 6, lower right column, page 11, and Japanese Patent Application No. 4-29075.

The color developing agent for use in the color development procedure include known aromatic primary amine color developing agents. Preferred examples of the aromatic primary amine color developing agent include p-phenylenediamine derivatives. Typical examples of such p-phenylenediamine derivatives include 4-amino-N-ethyl-N-(β-hydroxyethyl)-3-methylaniline, 4-amino-N-ethyl-N-(3-hydroxypropyl)-3-methylaniline, 4-amino-N-ethyl-N-(4-hydroxybutyl)-3-methylaniline, 4-amino-N-ethyl-N-(β-methanesulfonamideethyl)-3-methylaniline, 4-amino-N-(3-carbamoylpropyl-N-n-propyl-3-methylaniline, and 4-amino-N-ethyl-N-(β-hydroxyethyl)-3-methoxyaniline. The compounds disclosed in European Patent Application 410450, and JP-A-4-11255 are other examples of p-phenylenediamine derivatives which are preferably used in the present invention.

These p-phenylenediamine derivatives may be in the form of a sulfate, hydrochloride, sulfite, naphthalenedisulfonate, p-toluenesulfonate or the like. The addition amount of the aromatic primary amine developing agent is preferably in the range of 0.0002 mol to 0.2 mol, more preferably 0.001 mol to 0.1 mol per l of the color developer.

The temperature at which processing is effected with the color developer of the present invention is in the range of from 20° to 55 ° C., preferably 30° to 55 ° C. The time during which the processing is effected with the color developer of the present invention is in the range of from 20 seconds to 5 minutes, preferably 30 seconds to 200 seconds, more preferably 60 seconds to 150 seconds for picture-taking photographic light-sensitive materials. For printing photographic light-sensitive materials, the color developing time is the range of from 10 seconds to 80 seconds, preferably 10 seconds to 60 seconds, more preferably 10 seconds to 40 seconds.

The processing method of the present invention may be used for color reversal processing. The black-and-white developer for use in color reversal processing is called a 1st black-and-white developer for reversal of known color photographic light-sensitive materials. The 1st black-and-white developer for color reversal processing may comprise various well-known additives adapted for addition to a black-and-white developer for processing of black-and-white silver halide photographic materials.

Typical examples of such additives include developing agents such as 1-phenyl-3-pyrazolidone, methol and hydroquinone, preservatives such as sulfite, accelerators containing an alkali such as sodium hydroxide, sodium carbonate and potassium carbonate, inorganic or organic inhibitors such as potassium bromide, 2-methylbenzimidazole and methylbenzthiazole, water softeners such as polyphosphate, and development inhibitors containing a small amount of an iodide or mercapto compound.

In the present invention, the photographic light-sensitive material which has been desilvered is then subjected to rinsing and/or stabilizing. For the rinsing and stabilizing procedures, the stabilizers disclosed in U.S. Pat. No. 4,786,583 may be employed. These stabilizers may comprise formaldehyde as a stabilizing agent. To provide a safe working environment, N-methylolazole, hexamethylenetetramine, formaldehyde-bisulfurous acid adduct, dimethylolurea and azolylmethylamine are preferred. These stabilizing agents are further described in JP-A-2-153348, and Japanese Patent Application Nos. 2-400906, 2-401513, and 3-48679. In particular, azoles such as 1,2,4-triazole and azolylmethylamine such as 1,4-bis(1,2,4-triazole-1-ilmethyl)piperadine and derivatives thereof (as described in JP-A-4-359249) are preferably used in combination to provide high image stability and a low formaldehyde vapor pressure.

The use of a free chelete agent forming the metal chelete compound of the present invention as a black-and-white developer or a color developer in amount of about 0.05 to 10 g/l exibits excellent effects such as prevention of precipitation of developer thereof or generation of sludge, prevention of decomposition of a developing agent or a preservative and prevention of fluctuation of photographic properties (sensitivity, gradation, etc.).

The use of a free chelete agent forming the metal chelete compound of the present invention as a black-and-white or color fixing solution or blixing solution in an amount of 0.05 to 40 g/l exibits excellent effects such as improvement of solution stability of the developer thereof, prevention of generation of solution turbidity or sludge and prevention of stain at non-image part after processing.

The use of a free chelete agent forming the metal chelete compound of the present invention as a bleaching solution in an amount of 0.05 to 20 g/l exibits excellent effects such as improvement of solution stability or bleaching inferiority.

The use of a free chelete agent forming the metal chelete compound of the present invention as a rinsing water or stabilizer in an amount of 0.001 to 5 g/l exibits excellent effects such as prevention of generation of turbidity of the solution thereof, prevention of deterioration of preservativity in a dye image and prevention of generation of stain at non-image part.

Examples of photographic light-sensitive materials to which the processing method of the present invention can be applied include color negative film, color reversal film (coupler-in-emulsion type, coupler-in-developer type), color paper, color reversal paper, color negative film for motion picture, color positive film for motion picture, color negative slide, color reversal film for television, and direct positive color paper. These photographic light-sensitive materials are described in JP-A-3-33847, JP-A-3-293662, and JP-A-4-130432- The support for the photographic light-sensitive material of the present invention, the coating method, the kind of silver halide grains coated on the silver halide emulsion layer, the surface protective layer, etc. (e.g., silver bromoiodie, silver bromochloroiodide, silver bromide, silver bromochloride, silver chloride), the crystal form thereof (e.g., cube, tablet, sphere), the size thereof, the grain size fluctuation coefficient, the crystalline structure thereof (e.g., core/shell structure, polyphase structure, uniform phase structure), the preparation method thereof (e.g., single jet process, double jet process), the binder to be incorporated therein (e.g., gelatin), the film hardener to be incorporated therein, the fog inhibitor to be incorporated therein, the metal doping agent to be incorporated therein , the silver halide solvent to be incorporated therein, the thickening agent to be incorporated therein, the emulsion precipitant to be incorporated therein, the dimensional stabilizer to be incorporated therein, the adhesion inhibitor to be incorporated therein, the stabilizer to be incorporated therein, the color stain inhibitor to be incorporated therein, the dye stabilizer to be incorporated therein, the stain inhibitor to be incorporated therein, the chemical sensitizer to be incorporated therein, the spectral sensitizer to be incorporated therein, the sensitivity improver to be incorporated therein, the supersensitizer to be incorporated therein, the nucleating agent to be incorporated therein, the coupler to be incorporated therein (e.g., pivaloylacetanilide type or benzoylacetanilide type yellow coupler, 5-pyrazolone type or pyrazoloazole type magenta coupler, phenol type or naphthol type cyan coupler, DIR coupler, bleach accelerator-releasing coupler, competing coupler, colored coupler), the coupler dispersion method (e.g., oil-in-water dispersion method using a high boiling point solvent), the plasticizer to be incorporated therein, the antistatic agent to be incorporated therein, the lubricant to be incorporated therein, the coating aid to be incorporated therein, the surface active agent to be incorporated therein, the brightening agent to be incorporated therein, the formalin scavenger to be incorporated therein, the light scattering agent to be incorporated therein, the matting agent to be incorporated therein, the light absorbent to be incorporated therein, the ultraviolet absorbent to be incorporated therein, the filter dye to be incorporated therein, the irradiation dye to be incorporated therein, the development improver to be incorporated therein, the delusterant to be incorporated therein, the preservative to be incorporated therein (e.g., 2-phenoxyethanol), and the mildewproofing agent to be incorporated therein are not particularly limited. For these items, reference can be made to Product Licensing, vol. 92, pp. 107–110, December 1971, and Research Disclosure (hereinafter referred as "RD") Nos. 17643 (December 1978), 18716 (November 1979), and 307105 (November 1989).

The color photographic light-sensitive material of the present invention can be used in various forms of a color photographic light-sensitive material without particular restriction. In the present invention, the dry thickness of all the constituent layers of the color photographic light-sensitive material excluding that of the support and its undercoating and back layers is preferably in the range of 20.0 μm or less, more preferably 18.0 μm or less, for picture-taking color photographic light-sensitive materials to best achieve the effects of the present invention. For printing photographic light-sensitive materials, the dry thickness is in the range of 16.0 μm or less, more preferably 13.0 μm or less.

If the film thickness deviates from the above specified range, the residual developing agent after color development causes bleaching fog or an increase in staining after processing. The occurrence of bleaching fog or staining is attributed to the green-sensitive layer. As a result, the magenta sensitization tends to be greater than the cyan or yellow sensitization.

The lower limit of the film thickness is preferably minimized within the above specified range so far as the properties of the photographic light-sensitive material are not impaired. The lower limit of the total dry film thickness of all the constituent layers of the photographic light-sensitive material excluding that of the support and its undercoating layer is about 12.0 μm for picture-taking color photographic light-sensitive materials or about 7.0 μm for printing photographic light-sensitive materials. In the case of picture-taking photographic light-sensitive materials, a layer is normally provided between the light-sensitive layer nearest to the support and the undercoating layer on the support. The lower limit of the total dry film thickness of such a layer (or plurality of layers) is 1.0 μm. The reduction of film thickness may be effected in either a light-sensitive layer or a light-insensitive layer.

The swelling percentage of the color photographic light-sensitive material of the present invention [((equilibrium swollen film thickness at 25 ° C. in $H_2O$ - total dry film thickness at 25 ° C. and 55 % RH)/total dry film thickness at 25 ° C. and 55 % RH)×100] is preferably in the range of from 50 to 200%, more preferably 70 to 150%. If the swelling percentage deviates from the above specified range, the amount of residual color developing agent is increased, to thereby adversely affect the photographic properties, image quality such as desilverability, and film physical properties such as film strength Concerning the swelling rate of the color photographic light-sensitive material of the present invention, 90% of the maximum swollen film thickness in the color developer (30 ° C., 195 seconds) is defined as the saturated swollen film thickness. The time passed until half the saturated swollen film thickness is reached is defined as $T_{\frac{1}{2}}$. In the present invention, $T_{\frac{1}{2}}$ is preferably in the range of 15 seconds or less, more preferably 9 seconds or less.

The composition of the silver halide grains incorporated in the photographic emulsion layer in the color photographic light-sensitive material of the present invention is not particularly limited. Examples of the silver halide include silver chloride, silver bromide, silver bromochloride, silver bromoiodide, silver chloroiodide and silver bromochloroiodide.

In the case of picture-taking color photographic light-sensitive materials or color reversal photographic light-sensitive materials (e.g., color negative film, reversal film, color reversal paper), silver bromoiodide, silver chloroiodide or silver bromochloroiodide having a silver iodide content of from 0.1 to 30 mol % is preferably used. In particular, silver bromoiodide having a silver iodide content of from 1 to 25 mol % is preferred. In the case of a direct positive color photographic light-sensitive material comprising an internal latent image type emulsion which has not been previously fogged, silver bromide or silver bromochloride is preferred. Also, silver chloride is preferably used to provide rapid processing. In the case of photographic light-sensitive materials for photographic paper, silver chloride or silver bromochloride is preferred. In particular, silver bromochloride having a silver chloride content of 80 mol % or more, more preferably 95 mol % or more, most preferably 98 mol % or more is preferred.

The color photographic light-sensitive material to which the processing method of the present invention is applied may comprise various color couplers. Specific examples of these color couplers are disclosed in the patents cited in the above cited RD Nos. 17643, VII-C to G, and 307105, VII-C to G, JP-A-62-215272, JP-A-3-33847, and JP-A-2-33144, and European Patent Applications 447969A and 482552A.

Useful yellow couplers include those described in U.S. Pat. Nos. 3,933,501, 4,022,620, 4,326,024, 4,401,752, 4,248,961, 3,973,968, 4,314,023, 4,511,649 and 5,118,599, JP-B-58-10739, British Patents 1,425,020, and 1,476,760, European Patents 249,473A and 0,447,669, and JP-A-63-23145, JP-A-63-123047, JP-A-1-250944, and JP-A-1-213648 so long as the effects of the present invention are not unduly impaired.

Particularly preferred examples of yellow couplers include the yellow couplers of general formula (Y) in JP-A-2-139544, upper left column, page 18 - lower left column, page 22, the acylacetamide yellow couplers characterized by acyl group as disclosed in JP-A-5-002248, and European Patent Application 0447969, and the yellow couplers of general formula (Cp-2) in JP-A-5-027389, and European Patent Application 0446863A2.

Preferred magenta couplers include 5-pyrazolone compounds and pyrazoloazole compounds. More preferred are those described in U.S. Pat. Nos. 4,310,619, 4,351,897, 3,061,432, 3,725,067, 4,500,630, 4,540,654, and 4,556,630, European Patent 73,636, JP-A-60-33552, JP-A-60-43659, JP-A-61-72238, JP-A-60-35730, JP-A-55-118034, and JP-A-60-185951, RD Nos. 24220 (June 1984) and 24230 (June 1984), and WO88/04795.

Particularly preferred examples of magenta couplers include the pyrazoloazole magenta couplers of general formula (I) disclosed in JP-A-2-139544, lower right column, page 3 - lower right column, page 10, and the 5-pyrazolone magenta couplers of general formula (M-1) disclosed in JP-A-2-139544, lower left column, page 17 - upper left column, page 21. Most preferred among these magenta couplers are the foregoing pyrazoloazole magenta couplers.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Application (OLS) 3,329,729, European Patents 0,121,365A and 0,249,453A, and JP-A-61-42658. Furthermore, the pyrazoloazole couplers as disclosed in JP-A-64-553, JP-A-64-554, JP-A-64-555, and JP-A-64-556, the pyrrolotriazole couplers disclosed in European Patent Applications 0,488,248A, and 0,491,197A, the pyrroloimidazole couplers disclosed in European Patent Application 0,456,226A, the pyrazolopyrimidine couplers disclosed in JP-A-64-46753, the imidazole couplers disclosed in U.S. Pat. No. 4,818,672, and JP-A-2-33144, the cyclic active methylenic cyan couplers disclosed in JP-A-64-32260, and the couplers disclosed in JP-A-1-183658, JP-A-2-262655, JP-A-2-85851, and JP-A-3-48243 can be used.

Typical examples of polymerized dye-forming couplers are disclosed in U.S. Pat. Nos. 3,451,820, 4,080,211, 4,367,282, 4,409,320, and 4,576,910, British Patent 2,102,137, and European Patent 341,188A.

Useful couplers which release a dye having a proper diffusibility preferably include those disclosed in U.S. Pat. No. 4,366,237, British Patent 2,125,570, European Patent 96,570, and West German Patent Application (OLS) 3,234,533.

Compounds capable of releasing a photographically useful residue upon coupling can also be used in the present invention. Preferred examples of DIR couplers which release a development inhibitor are described in the patents cited in RD 17643, VII-F, JP-A-57-151944, JP-A-57-154234, JP-A-60-184248, JP-A-63-37346, and JP-A-63-37350, and U.S. Pat. Nos. 4,248,962, and 4,782,012.

Couplers which imagewise release a nucleating agent or a developing accelerator at the time of development preferably include those described in British Patents 2,097,140 and 2,131,188, and JP-A-59-157638 and JP-A-59-170840.

Other examples of couplers which can be incorporated in the color photographic element according to the present invention include the competing couplers described in U.S. Pat. No. 4,130,427, the polyequivalent couplers described in U.S. Pat. Nos. 4,283,472, 4,338,393, and 4,310,618, the DIR redox compound-releasing couplers, DIR coupler-releasing redox compounds or DIR redox-releasing redox compounds described in JP-A-60-185950 and 62-24252, the couplers capable of releasing a dye which returns to its original color after release described in European Patents 173,302A, the bleach accelerator-releasing couplers disclosed in RD Nos. 11449, and 24241, and JP-A-61-201247, the couplers capable which release a ligand described in U.S. Pat. No. 4,553,477, the couplers which release a leuco dye described in JP-A-63-75747, and the couplers which release a fluorescent dye as described in U.S. Pat. No. 4,774,181.

Examples of appropriate supports for use in the present invention are described in the above cited RD Nos. 17643, page 28, and 18716, right column on page 647 - left column on page 648.

The processing composition of the present invention can also be used as a reducer for correcting a silver image made of dots and/or a line original obtained by development of a plate-making silver halide photographic material which has been exposed to light.

The present invention is further described in the following Examples, but the present invention should not be construed as being limited thereto.

EXAMPLE 1

A multi-layer color light-sensitive material was prepared as Specimen 101 by coating on an undercoated cellulose triacetate film support various layers having the following compositions:

Composition of Light-sensitive Layer

Materials incorporated in the various layers are classified into the following categories:

ExC: cyan coupler; ExM: magenta coupler; ExY: yellow coupler; ExS: sensitizing dye; UV: ultraviolet absorbent; HBS: high boiling organic solvent; H: gelatin hardener The coated amount of silver halide and colloidal silver is represented in g/m$^2$ calculated in terms of silver. The coated amounts of coupler, additive and gelatin is represented in g/m$^2$. The coated amount of sensitizing dye is represented in terms of number of moles per mole of silver halide in the same layer.

| | |
|---|---|
| 1st layer: antihalation layer | |
| Black colloidal silver | 0.20 (in terms of silver) |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| HBS-1 | 0.30 |
| HBS-2 | $1.2 \times 10^{-2}$ |
| 2nd layer: interlayer | |
| Finely divided silver bromoiodide grains (AgI content: 1.0 mol %; diameter calculated in terms of sphere: 0.07 μm) | 0.15 (in terms of silver) |
| Gelatin | 1.00 |
| ExC-4 | $6.0 \times 10^{-2}$ |
| Cpd-3 | $2.0 \times 10^{-2}$ |
| 3rd layer: low sensitivity red-sensitive emulsion layer | |
| Silver bromoiodide emulsion A | 0.42 in terms of silver |
| Silver bromoiodide emulsion B | 0.40 in terms of silver |
| Gelatin | 1.90 |
| ExS-1 | $6.8 \times 10^{-4}$ mol |
| ExS-2 | $2.2 \times 10^{-4}$ mol |
| ExS-3 | $6.0 \times 10^{-5}$ mol |
| ExC-1 | 0.65 |
| ExC-3 | $1.0 \times 10^{-2}$ |
| ExC-4 | $2.3 \times 10^{-2}$ |
| HBS-1 | 0.32 |
| 4th layer: middle sensitivity red-sensitive emulsion layer | |
| Silver bromoiodide emulsion C | 0.85 in terms of silver |
| Gelatin | 0.91 |
| ExS-1 | $4.5 \times 10^{-4}$ mol |
| ExS-2 | $1.5 \times 10^{-4}$ mol |
| ExS-3 | $4.5 \times 10^{-5}$ mol |
| ExC-1 | 0.13 |
| ExC-2 | $6.2 \times 10^{-2}$ |
| ExC-4 | $4.0 \times 10^{-2}$ |
| ExC-6 | $3.0 \times 10^{-2}$ |
| HBS-1 | 0.10 |
| 5th layer: high sensitivity red-sensitive emulsion layer | |

-continued

| | |
|---|---|
| Silver bromoidode emulsion D | 1.50 in terms of silver |
| Gelatin | 1.20 |
| ExS-1 | $3.0 \times 10^{-4}$ mol |
| ExS-2 | $9.0 \times 10^{-5}$ mol |
| ExS-3 | $3.0 \times 10^{-5}$ mol |
| ExC-2 | $8.5 \times 10^{-2}$ |
| ExC-5 | $3.6 \times 10^{-2}$ |
| ExC-6 | $1.0 \times 10^{-2}$ |
| ExC-7 | $3.7 \times 10^{-2}$ |
| HBS-1 | 0 12 |
| HBS-2 | 0.12 |
| 6th layer: interlayer | |
| Gelatin | 1.00 |
| Cpd-4 | $8.0 \times 10^{-2}$ |
| HBS-1 | $8.0 \times 10^{-2}$ |
| 7th layer: low sensitivity green-sensitive emulsion layer | |
| Silver bromoiodide emulsion E | 0.28 in terms of silver |
| Silver bromoiodide emulsion F | 0.16 in terms of silver |
| Gelatin | 1.20 |
| ExS-4 | $7.5 \times 10^{-4}$ mol |
| ExS-5 | $3.0 \times 10^{-4}$ mol |
| ExS-6 | $1.5 \times 10^{-4}$ mol |
| ExM-1 | 0.50 |
| ExM-2 | 0.10 |
| ExM-5 | $3.5 \times 10^{-2}$ |
| HBS-1 | 0.20 |
| HBS-3 | $3.0 \times 10^{-2}$ |
| 8th layer: middle sensitivity green-sensitive emulsion layer | |
| Silver bromoiodide emulsion G | 0.57 in terms of silver |
| Gelatin | 0.45 |
| ExS-4 | $5.2 \times 10^{-4}$ mol |
| ExS-5 | $2.1 \times 10^{-4}$ mol |
| ExS-6 | $1.1 \times 10^{-4}$ mol |
| ExM-1 | 0.12 |
| ExM-2 | $7.1 \times 10^{-3}$ |
| ExM-3 | $3.5 \times 10^{-2}$ |
| HBS-1 | 0.15 |
| HBS-3 | $1.0 \times 10^{-2}$ |
| 9th layer: interlayer | |
| Gelatin | 0.50 |
| HBS-1 | $2.0 \times 10^{-2}$ |
| 10th layer: high sensitivity green-sensitive emulsion layer | |
| Silver bromoiodide emulsion H | 1.30 in terms of silver |
| Gelatin | 1.20 |
| ExS-4 | $3.0 \times 10^{-4}$ mol |
| ExS-5 | $1.2 \times 10^{-4}$ mol |
| ExS-6 | $1.2 \times 10^{-4}$ mol |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| HBS-1 | 0.25 |
| 11th layer: yellow filter layer | |
| Gelatin | 0.50 |
| Cpd-6 | $5.2 \times 10^{-2}$ |
| HBS-1 | 0.12 |

-continued

| | |
|---|---|
| 12th layer: interlayer | |
| Gelatin | 0.45 |
| Cpd-3 | 0.10 |
| 13th layer: low sensitivity blue-sensitive emulsion layer | |
| Silver bromoiodide emulsion I | 0.20 in terms of silver |
| Gelatin | 1.00 |
| ExS-7 | $3.0 \times 10^{-4}$ mol |
| ExY-1 | 0.60 |
| ExY-2 | $2.3 \times 10^{-2}$ |
| HBS-1 | 0.15 |
| 14th layer: middle sensitivity blue-sensitive emulsion layer | |
| Silver bromoiodide emulsion J | 0.19 in terms of silver |
| Gelatin | 0.35 |
| ExS-7 | $3.0 \times 10^{-4}$ mol |
| ExY-1 | 0.22 |
| HBS-1 | $7.0 \times 10^{-2}$ |
| 15th layer: interlayer | |
| Finely divided silver bromoiodide grains (AgI content: 2 mol %; uniform AgI type; diameter in terms of sphere: 0.13 μm) | 0.20 in terms of silver |
| Gelatin | 0.36 |
| 16th layer: high sensitivity blue-sensitive emulsion layer | |
| Silver bromoiodide emulsion K | 1.55 in terms of silver |
| Gelatin | 1.00 |
| ExS-8 | $2.2 \times 10^{-4}$ mol |
| ExY-1 | 0.21 |
| HBS-1 | $7.0 \times 10^{-2}$ |
| 17th layer: 1st protective layer | |
| Gelatin | 1.80 |
| UV-1 | 0.13 |
| UV-2 | 0.21 |
| HBS-1 | $1.0 \times 10^{-2}$ |
| HBS-2 | $1.0 \times 10^{-2}$ |
| 18th layer: 2nd protective layer | |
| Finely divided silver chloride grains (diameter in terms of sphere: 0.07 μm) | 0.36 in terms of silver |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

Besides the above mentioned components, these specimens comprised 1,2-benzisothiazoline-3-one (200 ppm based on gelatin on the average), n-butyl-p-hydroxybenzoate (about 1,000 ppm based on gelatin on the average) and 2-phenoxyethanol (about 10,000 ppm based on gelatin on the average). Furthermore, B-4, B-5, B-6, W-2, W-3, F-1 to F-15, iron salt, lead salt, gold salt, platinum salt, iridium salt, rhodium salt and palladium salt were incorporated in these specimens. The above noted additives, use and addition amounts thereof to obtain the desired function are well known to those of ordinary skill in the art.

TABLE 1

| Silver bromoiodide emulsion | Average AgI content (%) | Diameter in terms of Sphere (μm) | Grain diameter fluctuation coefficient (%) | Average diameter in terms of sphere (μm) | Average thickness (μm) | Grain structure | Grain shape |
|---|---|---|---|---|---|---|---|
| A | 9 | 0.75 | 18 | 1.16 | 0.21 | Triple* | Tablet |
| B | 3 | 0.50 | 10 | 0.50 | 0.50 | Triple | Cube |
| C | 9 | 0.83 | 15 | 1.32 | 0.22 | Triple | Tablet |
| D | 5 | 1.20 | 15 | 1.90 | 0.32 | Triple | Tablet |
| E | 5 | 0.70 | 18 | 1.13 | 0.18 | Triple | Tablet |
| F | 3 | 0.48 | 10 | 0.48 | 0.48 | Triple | Octahedron |
| G | 7 | 0.80 | 15 | 1.25 | 0.22 | Triple | Tablet |
| H | 4.5 | 1.15 | 15 | 1.97 | 0.26 | Triple | Tablet |
| I | 1.5 | 0.55 | 20 | 0.90 | 0.14 | Triple | Tablet |
| J | 8 | 0.80 | 16 | 1.19 | 0.24 | Triple | Tablet |

TABLE 1-continued

| Silver bromoiodide emulsion | Average AgI content (%) | Diameter in terms of Sphere (μm) | Grain diameter fluctuation coefficient (%) | Average diameter in terms of sphere (μm) | Average thickness (μm) | Grain structure | Grain shape |
|---|---|---|---|---|---|---|---|
| K | 7 | 1.45 | 14 | 2.31 | 0.38 | Triple | Tablet |

*Triple represents that a grain has a structure consisting of three layers having two or more different silver halide compositions in the grain.

In Table 1, (1) The various emulsions were subjected to reduction sensitization with thiourea dioxide and thiosulfonic acid in accordance with an example in JP-A-2-191938;

(2) The various emulsions were subjected to gold sensitization, sulfur sensitization and selenium sensitization in the presence of the spectral sensitizing dye as set forth with reference to the various light-sensitive layers and sodium thiocyanate in accordance with an example in JP-A-3-237450;

(3) The preparation of tabular grains was carried out using a low molecular weight gelatin in accordance with JP-A-l-158426; and (4) The tabular grains and normal crystal grains having a grain structure (normal crystal grains having layers having different halogen compositions therein) were observed under a high voltage electron microscope to exhibit a transition line as described in JP-A-3-237450.

UV-1

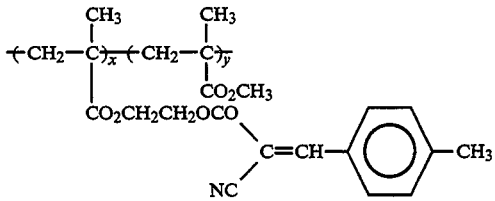

x/y = 7/3 (weight ratio)

UV-2

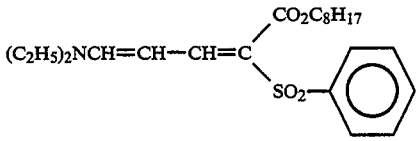

ExC-1

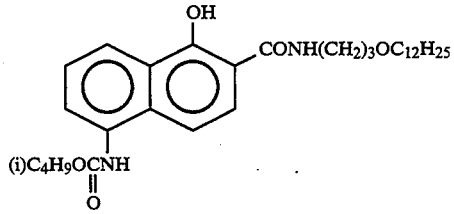

ExC-2

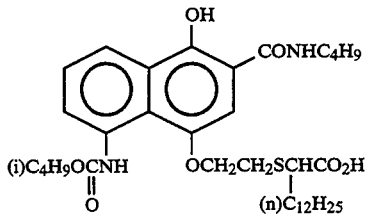

ExC-3

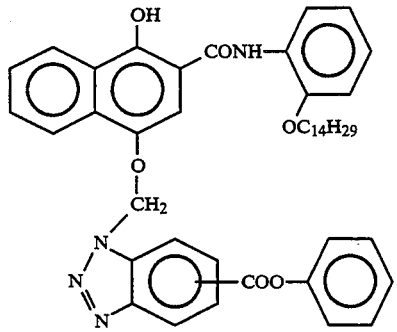

-continued
ExC-4
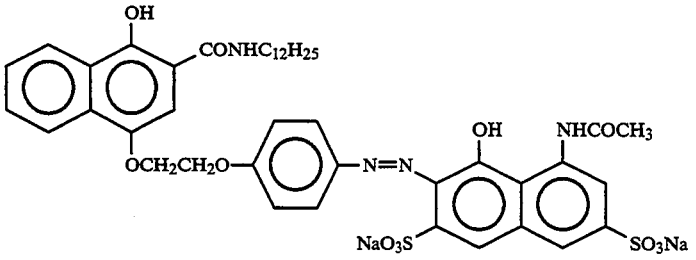
ExC-5
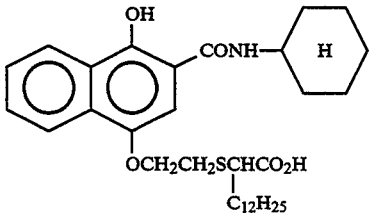
ExC-6
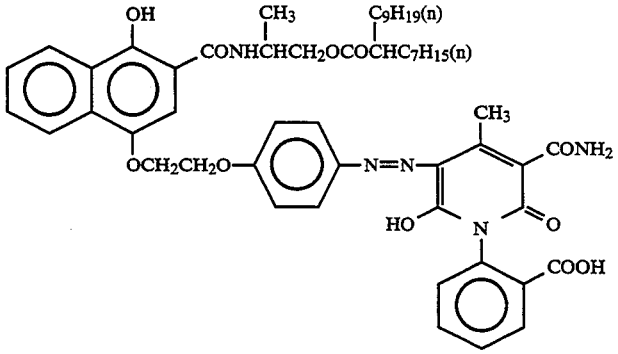
ExC-7
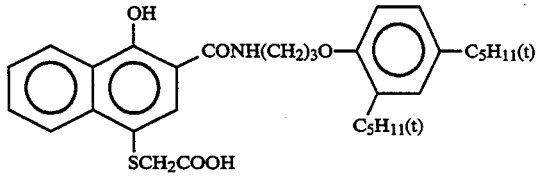
ExM-1
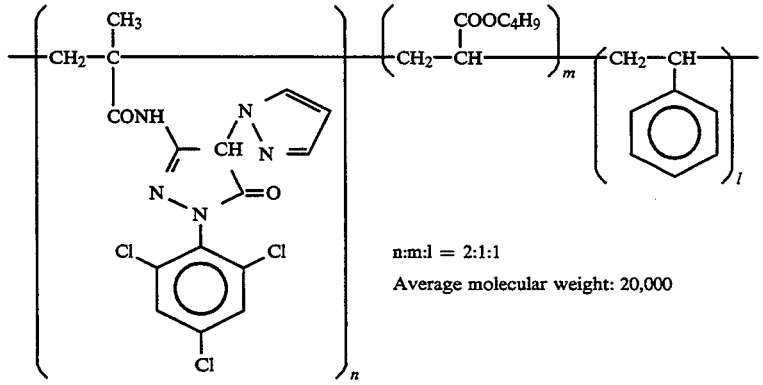
n:m:l = 2:1:1
Average molecular weight: 20,000

-continued
ExM-2
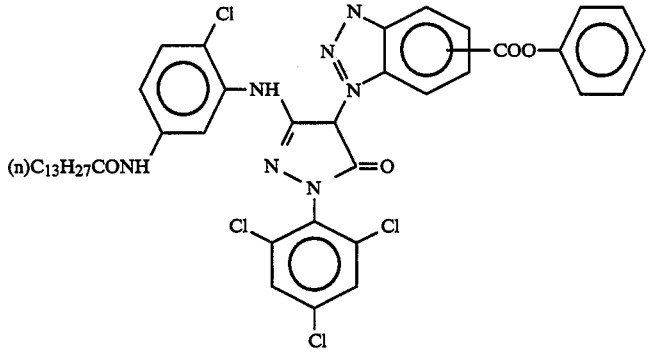
ExM-3
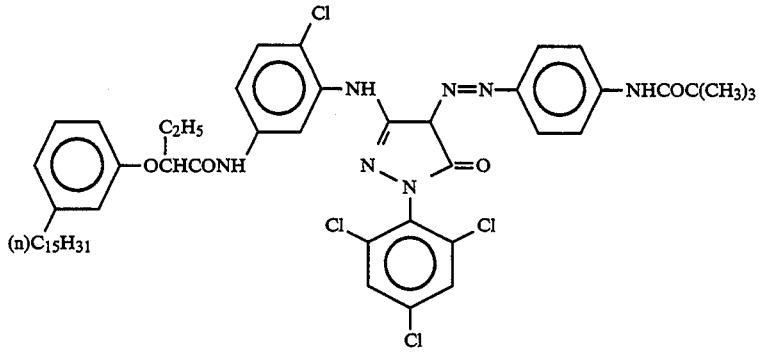
ExM-4
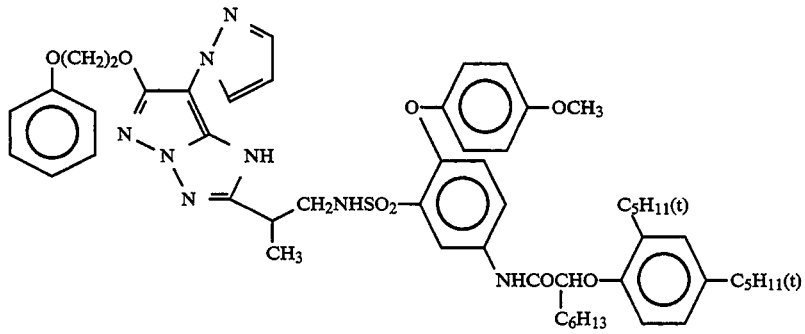
ExM-5
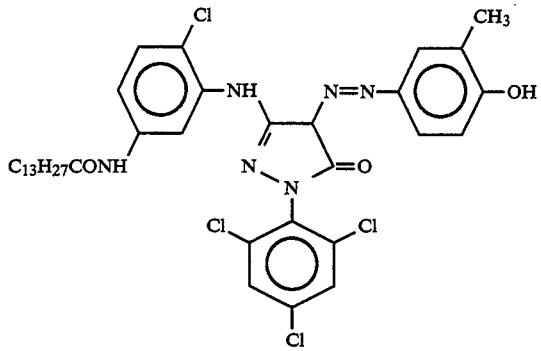
ExM-6
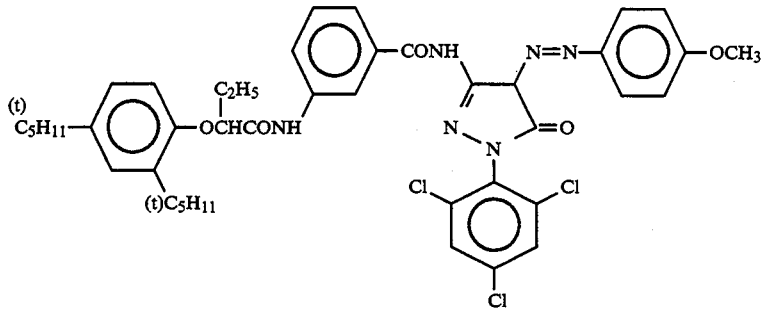

-continued
Cpd-5
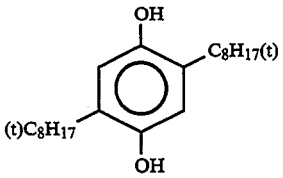
Cpd-6
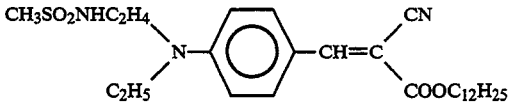
Cpd-7
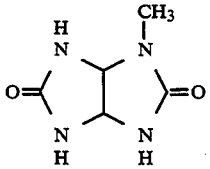
HBS-1
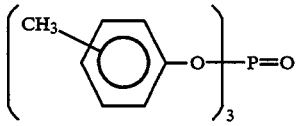
HBS-2
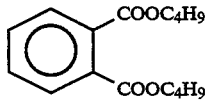
HBS-3
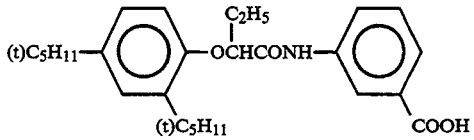
ExS-1
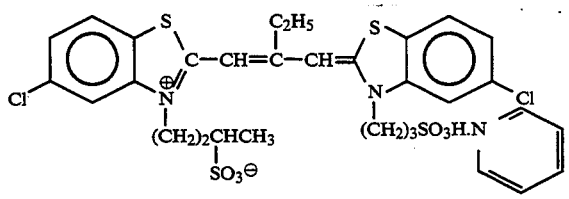
ExS-2
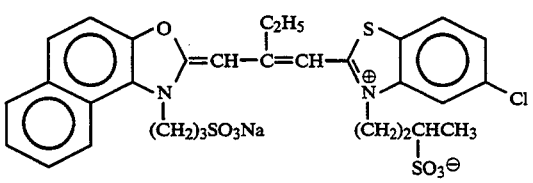
ExS-3
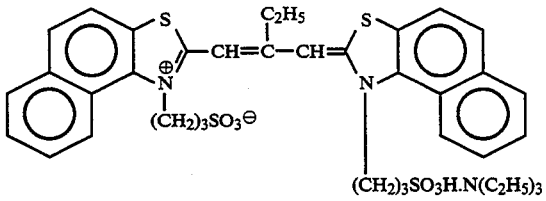

-continued
ExY-1
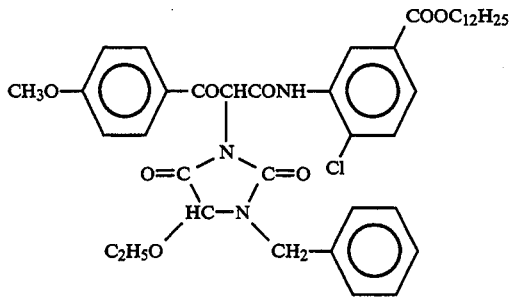
ExY-2
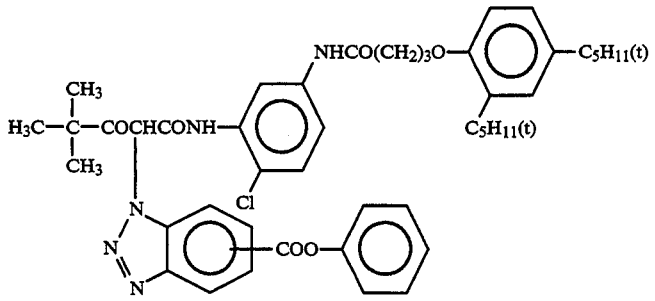
Cpd-1
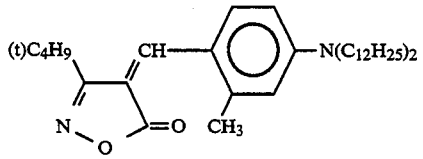
Cpd-2
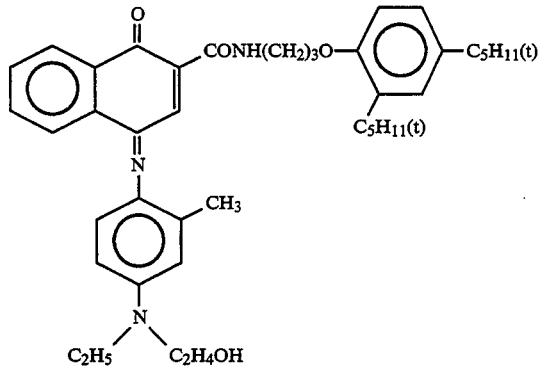
Cpd-3
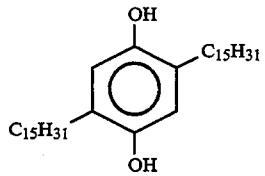
Cpd-4
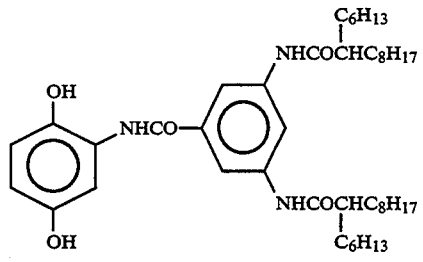

-continued
ExS-4
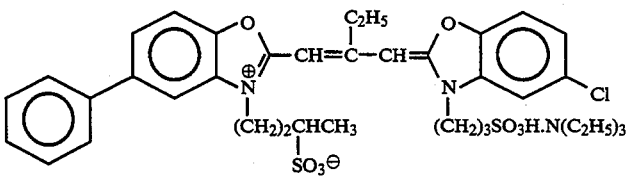
ExS-5
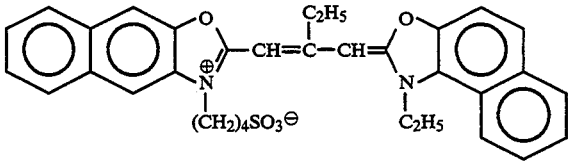
ExS-6
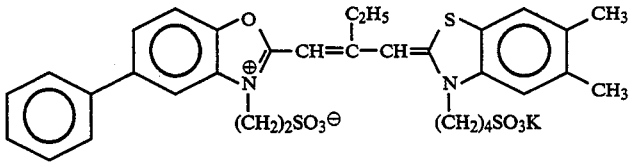
ExS-7
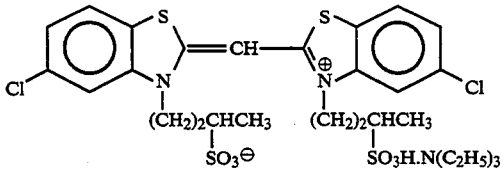
ExS-8
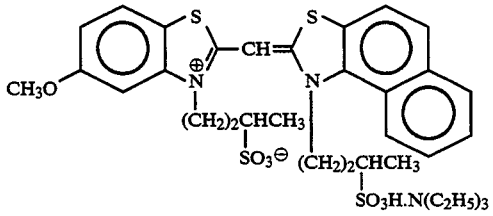
B-1
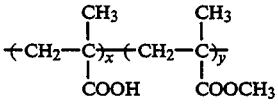
x/y = 10/90 (mol ratio)
B-2
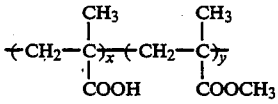
x/y = 40/60 (mol ratio)
B-3
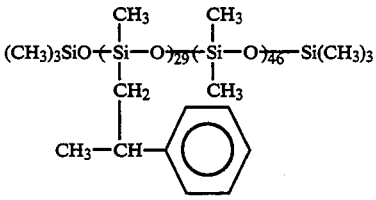
B-4
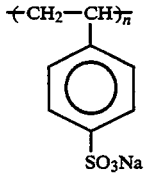

-continued
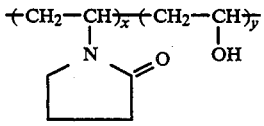
x/y = 70/30 (mol ratio) B-5
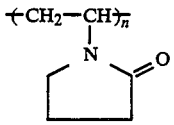
(mol. wt. about 10,000) B-6
$C_8F_{17}SO_2NHCH_2CH_2CH_2OCH_2CH_2\overset{\oplus}{N}(CH_3)_3$
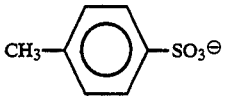
W-1
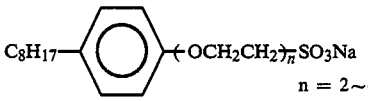
n = 2~4 W-2
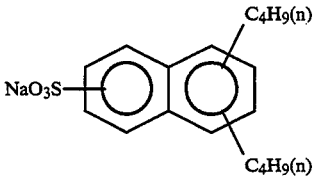
W-3
$CH_2{=}CH{-}SO_2{-}CH_2{-}CONH{-}CH_2$
$CH_2{=}CH{-}SO_2{-}CH_2{-}CONH{-}CH_2$ H-1
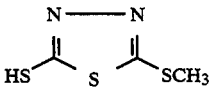
F-1
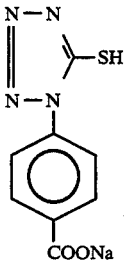
F-2
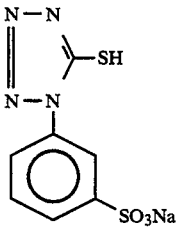
F-3
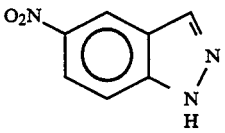
F-4

-continued
F-5
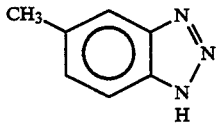
F-6
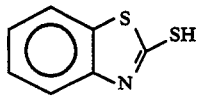
F-7
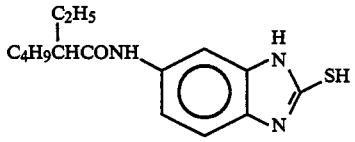
F-8
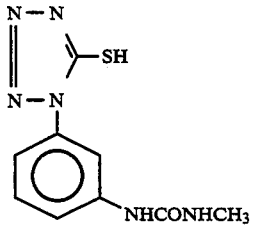
F-9
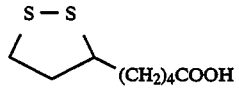
F-10
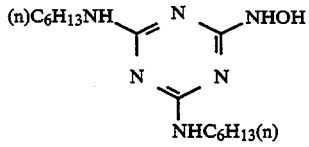
F-11
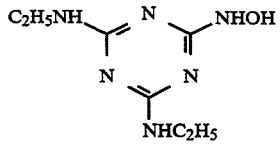
F-12
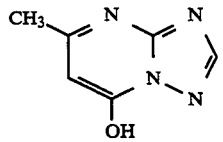
F-13
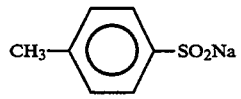
F-14
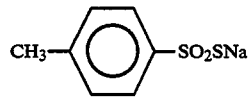
F-15
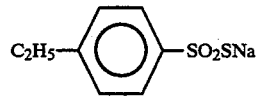
These specimens were each cut into 35-mm wide strips, wedgewise exposed to light at a color temperature of 4,800 K, and then processed with the following processing solutions using the following processing procedures by means of a processing machine for motion pictures (FNCP-900, Fuji Photo Film Co., Ltd.).

Separate bleaching solutions were prepared for each of Specimens 201 to 212, including comparative examples. The respective bleaching solutions were exchanged in processing the various specimens.

| (Processing method) | | |
|---|---|---|
| Processing Step | Processing time | Processing temperature |
| Color development | 3 min. 15 sec. | 37.8° C. |
| Bleach | 3 min. 00 sec. | 38.0 ° C. |
| Rinse | 30 sec. | 38.0 ° C. |
| Fixing | 3 min. 00 sec. | 38.0 ° C. |
| Rinse (1) | 30 sec. | 38.0 ° C. |
| Rinse (2) | 30 sec. | 38.0 ° C. |
| Stabilization | 1 min. 05 sec. | 38.0 ° C. |
| Drying | 2 min. 00 sec. | 55.0 ° C. |

The various processing solutions had the following compositions:

| Color developer | |
|---|---|
| Water | 800 ml |
| Potassium carbonate | 32.0 g |
| Sodium bicarbonate | 1.8 g |
| Sodium sulfite | 3.8 g |
| Potassium hydroxide | 1.7 g |
| Diethylenetriamine-pentaacetic acid | 1.2 g |
| 1-Hydroxyethylidene-1,1-diphosphonic acid | 2.0 g |
| Potassium bromide | 1.4 g |
| Potassium Iodide | 1.3 mg |
| Hydroxylamine sulfate | 2.5 g |
| 2-Methyl-4-(N-ethyl-N-β-hydroxy-ethylamino)aniline sulfate | 4.7 g |
| Water to make | 1,000 ml |
| pH | 10.05 |
| **Bleaching solution** | |
| Water | 700 ml |
| Chelate compound set forth in Table 2 | 0.28 mol |
| Ferric nitrate (III) nonahydrate | 0.25 mol |
| Ammonium bromide | 1.0 mol |
| Ammonium nitrate | 0.2 mol |
| Acetic acid | 0.5 mol |
| Water to make | 1,000 ml. |
| pH (adjusted with aqueous ammonia, nitric acid) | 4.5 |
| **Fixing solution** | |
| Water | 700 ml |
| Disodium ethylenediaminetetraacetate | 1.7 g |
| Sodium sulfite | 14.0 g |
| Ammonium thiosulfate | 170.0 g |
| Silver bromide | 15.0 g |
| Ammonium iodide | 0.9 g |
| Water to make | 1,000 ml |
| **Stabilizing solution** | |
| Water | 900 ml |
| 1,4-Bis(1,2,4-triazole-1-ilmethyl) piperazine | 0.75 g |
| 1,2,4-Triazole | 1.3 mol |

-continued

| | |
|---|---|
| p-Nonylphenyl-polyglycidole (average polymerization degree: 7) | 0.2 g |
| Disodium ethylenediaminetetraacetate | 0.05 g |
| Sodium p-toluenesulfinate | 0.03 g |
| Water to make | 1,000 ml |
| pH | 8.5 |

The photographic light-sensitive material specimens thus processed were evaluated with respect to amount of residual silver and bleach fog by the following methods: Amount of residual silver: The amount of silver remaining in the photographic light-sensitive material as determined by X-ray fluorescent analysis.

Bleach fog: The photographic light-sensitive material specimen which had been processed with the above described bleaching solutions 201 to 212 were measured for density. From the characteristic curve, Dmin as measured with green light was determined.

Another batch of the photographic light-sensitive material specimen was processed in the same manner as described above, except that the bleaching solution was replaced by the reference bleaching solution having the formulation as set forth below and the bleaching time was changed to 6 minutes and 30 seconds. The specimen was then measured for Dmin (used as the reference Dmin) in the same manner as described above.

The bleach fog of magenta dye layer is defined by the following equation:

Bleach fog=Drain−reference Drain

| (Reference bleaching solution) | |
|---|---|
| Water | 700 ml |
| Ethylenediaminetetraacetic acid | 0.28 mol |
| Ferric nitrate nonahydrate | 0.25 mol |
| Ammonium bromide | 1.4 mol |
| Ammonium nitrate | 0.2 mol |
| Water to make | 1,000 ml |
| pH (adjusted with aqueous ammonia, nitric acid) | 6.0 |

With the multi-layer color photographic light-sensitive material 101, the increase in magenta stain upon storage was determined. For the evaluation of magenta stain increase, the specimens thus processed were stored in the dark at 60° C., 70% RH for four weeks. The change in density Dmin was measured as follows:

Stain increase (ΔD) after 4 weeks=(Dmin after storage)−(Dmin before storage)

The results are set forth in Table 2.

TABLE 2

| No. | Chelate compound | Amount of residual silver ($\mu g/cm^2$) | Bleach fog ΔDmin(G) | Stain increase ΔD(G) | Remarks |
|---|---|---|---|---|---|
| 201 | Ethylenediamine-tetraacetic acid | 8.5 | 0.00 | 0.03 | Comparative |
| 202 | 1,3-Diaminopropane-tetraacetic acid | 2.1 | 0.10 | 0.12 | Comparative |
| 203 | β-Alaninediacetic Acid | 3.5 | 0.05 | 0.10 | Comparative |
| 204 | Exemplary Compound 1 | 2.5 | 0.02 | 0.03 | Present Invention |
| 205 | Exemplary Compound 2 | 2.9 | 0.03 | 0.04 | Present Invention |
| 206 | Exemplary Compound 5 | 2.0 | 0.02 | 0.03 | Present Invention |

TABLE 2-continued

| No. | Chelate compound | Amount of residual silver ($\mu g/cm^2$) | Bleach fog ΔDmin(G) | Stain increase ΔD(G) | Remarks |
|---|---|---|---|---|---|
| 207 | Exemplary Compound 6 | 2.3 | 0.02 | 0.04 | Present Invention |
| 208 | Exemplary Compound 11 | 3.0 | 0.02 | 0.04 | Present Invention |
| 209 | Exemplary Compound 14 | 3.3 | 0.01 | 0.03 | Present Invention |
| 210 | Exemplary Compound 16 | 3.8 | 0.01 | 0.03 | Present Invention |
| 211 | Exemplary Compound 18 | 2.1 | 0.02 | 0.05 | Present Invention |
| 212 | Exemplary Compound 20 | 2.7 | 0.03 | 0.05 | Present Invention |

Table 2 shows that the processing composition of the present invention comprehensively meets the desired objectives for desilverability, bleach fog and stain increase, and thus provides a useful.

EXAMPLE 2

Specimen 101 as described in the Examples of JP-A-2-44345 was prepared and exposed to light in the same manner as in Example 1 above. The specimen was then processed in the same manner as in Example 1, except that the bleaching solution was replaced by that given below and the bleaching time was changed to 4 minutes and 20 seconds.

| Bleaching agent | |
|---|---|
| Water | 700 ml |
| Compound set forth in Table 3 | 0.18 mol |
| Ferric nitrate (III) nonahydrate | 0.15 mol |
| Sodium bromide | 0.3 mol |
| Acetic acid | 0.5 mol |
| Water to make | 1,000 ml |
| pH (adjusted with potassium carbonate, nitric acid) | 5.5 |

The photographic light-sensitive material specimen thus processed was evaluated in terms of the amount of residual silver, bleach fog and increase in staining upon storage in the same manner as in Example 1. The results are set forth in Table 3.

TABLE 3

| No. | Chelate compound | Amount of residual silver ($\mu g/cm^2$) | Bleach fog ΔDmin(G) | Stain increase ΔD(G) | Remarks |
|---|---|---|---|---|---|
| 201 | Ethylenediamine-tetraacetic acid | 10.3 | 0.00 | 0.02 | Comparative |
| 302 | 1,3-Diaminopropane-tetraacetic acid | 1.9 | 0.13 | 0.08 | Comparative |
| 303 | β-Alaninediacetic Acid | 2.8 | 0.07 | 0.05 | Comparative |
| 304 | Exemplary Compound 1 | 2.0 | 0.03 | 0.02 | Present Invention |
| 305 | Exemplary Compound 2 | 2.2 | 0.04 | 0.03 | Present Invention |
| 306 | Exemplary Compound 5 | 1.7 | 0.03 | 0.02 | Present Invention |
| 307 | Exemplary Compound 6 | 1.9 | 0.03 | 0.03 | Present Invention |
| 308 | Exemplary Compound 11 | 2.3 | 0.02 | 0.03 | Present Invention |
| 309 | Exemplary Compound 14 | 2.5 | 0.01 | 0.02 | Present Invention |
| 310 | Exemplary Compound 16 | 2.8 | 0.01 | 0.01 | Present Invention |
| 311 | Exemplary Compound 18 | 1.8 | 0.02 | 0.03 | Present Invention |
| 312 | Exemplary Compound 20 | 2.3 | 0.04 | 0.03 | Present Invention |

Table 3 shows that the processing composition of the present invention comprehensively meets the desired objectives for desilverability, bleach fog and stain increase with time.

EXAMPLE 3

Ferric ammonium ethylenediaminetetraacetate and Compound K-2 and K-5 according to the present invention were subjected to biodegradation test in accordance with "OECD Chemical Test Guide Line Data analysis guide" (Daiichi Hoki Publication) 302B Revised Zahn-Wellens Method (pp. 1401 to 1411). As a result, ferric ammonium ethylenediaminetetraacetate showed little biodegradation after 28 days of testing, while Compound K-2 and K-5 according to the present invention showed 95% more biodegradation and which is considered to constitute excellent biodegradability.

As discussed above, the processing composition of the present invention can provide a rapid processing with little or no bleach fog and staining after processing and excellent desilverability. Furthermore, the processing composition of the present invention exhibits little fluctuation in processing properties during the course of continuous processing (i.e., before and after running processing). Moreover, the processing composition of the present invention contains a biodegradable compound that contributes to environmental protection.

While the invention has been described in detail and with reference to specific embodiments thereof, it will be apparent to one skilled in the art that various changes and modifications can be made therein without departing from the spirit and scope thereof.

What is claimed is:

1. A process for processing an imagewise exposed silver halide photographic material, comprising developing in a color developing solution containing a color developing agent and processing in a processing composition having a bleaching capacity containing as a bleaching agent a metal chelate compound of a chelate-forming compound or salt thereof and a metal ion selected from the group consisting of Fe(III), Mn(III), Co(III), Rh(II), Rh(III), Au(II), Au(III) and Ce(IV), said chelate-forming compound or salt thereof being represented by formula (I):

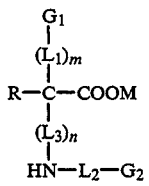

(I)

wherein $G_1$ and $G_2$ each represents a carboxyl group, a phosphono group, a sulfo group, a hydroxyl group, a mercapto group, an aryl group, a heterocyclic group, an alkylthio group, an amidino group, a guanidino group or a carbamoyl group; $L_1$, $L_2$ and $L_3$ each represents a divalent aliphatic group, a divalent aromatic group or a divalent connecting group formed by a combination of a divalent aliphatic group and a divalent aromatic group; m and n each represents an integer 0 or 1; R represents a hydrogen atom, an aliphatic group or an aromatic group; and M represents a hydrogen atom or a cation.

2. The process of claim 1, wherein $G_1$ is a carboxyl group, a hydroxyl group, an aryl group or a heterocyclic group.

3. The process of claim 1, wherein $G_1$ is a carboxyl group.

4. The process of claim 1, wherein $G_2$ is a carboxyl group, a hydroxyl group, a sulfo group, a phosphono group, an aryl group or a heterocyclic group.

5. The process of claim 1, wherein $G_2$ is a carboxyl group, an aryl group or a heterocyclic group.

6. The process of claim 1, wherein $G_2$ is a carboxyl group.

7. The process of claim 1, wherein $L_1$, $L_2$ and $L_3$ each is a $C_{1-3}$ alkylene or o-phenylene group which may be substituted.

8. The process of claim 1, wherein $L_1$, $L_2$ and $L_3$ each is a methylene or ethylene group which may be substituted.

9. The process of claim 1, wherein n is 1.

10. The process of claim 1, wherein n is 0.

11. The process of claim 1, wherein R is a hydrogen atom or a $C_{1-3}$ alkyl group.

12. The process of claim 1, wherein R is a hydrogen atom.

13. The process of claim 1, wherein the chelate-forming compound or salt thereof represented by formula (I) is represented by formula (II):

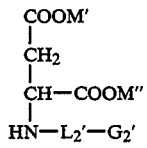

(II)

wherein $L_2'$ has the same meaning as $L_2$ in formula (I); $G_2'$ has the same meaning as $G_2$ in formula (I); and M' and M'' each has the same meaning as M in formula (I).

14. The process of claim 1, wherein the metal ion is selected from the group consisting of Fe(III), Mn(III) and Ce(IV).

15. The process of claim 1, wherein the processing composition having a bleaching capacity contains the chelate-forming compound or salt thereof represented by formula (I) in an amount of 1 to 30 mole per mole of the metal ion.

16. The process of claim 1, wherein the processing composition having a bleaching capacity contains the metal chelate compound in an amount of from 0.005 to 1 mol/l.

17. The process of claim 1, wherein the processing composition having a bleaching capacity is a bleaching solution or a blix solution.

18. The process of claim 1, wherein the processing composition having a bleaching capacity has a pH of from 2.0 to 8.0.

19. The process of claim 1, wherein the processing composition having a bleaching capacity contains ammonium ion in an amount of 0.1 mol/l or less.

20. The process of claim 1, comprising processing in the processing composition having a bleaching capacity for 10 seconds to 7 minutes at a temperature of from 30° C. to 60° C.

* * * * *